US011029626B2

(12) United States Patent
Torimaru et al.

(10) Patent No.: US 11,029,626 B2
(45) Date of Patent: Jun. 8, 2021

(54) IMAGE FORMING APPARATUS

(71) Applicant: CANON KABUSHIKI KAISHA, Tokyo (JP)

(72) Inventors: Yuusuke Torimaru, Toride (JP); Dai Kanai, Abiko (JP); Shozo Aiba, Tsukubamirai (JP); Tatsuya Kohno, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/411,558

(22) Filed: May 14, 2019

(65) Prior Publication Data

US 2019/0354044 A1 Nov. 21, 2019

(30) Foreign Application Priority Data

May 15, 2018 (JP) ..... JP2018-094149

(51) Int. Cl.
*G03G 15/16* (2006.01)

(52) U.S. Cl.
CPC ..... *G03G 15/1675* (2013.01)

(58) Field of Classification Search
CPC . G03G 15/1615; G03G 15/1675; G03G 15/55
See application file for complete search history.

(56) References Cited

U.S. PATENT DOCUMENTS 9,772,584 B2 9/2017 Aiba
2007/0059055 A1* 3/2007 Iwata ..... G03G 15/1615 399/302
2012/0076554 A1* 3/2012 Kaseda ..... G03G 15/161 399/316
2012/0263500 A1* 10/2012 Saka ..... G03G 15/167 399/177
2014/0294408 A1* 10/2014 Yoshioka ..... G03G 15/0136 399/44
2014/0294411 A1* 10/2014 Yoshioka ..... G03G 15/1695 399/45
2016/0282769 A1* 9/2016 Oishi ..... G03G 15/1615
2017/0308008 A1 10/2017 Aiba
2019/0129323 A1 5/2019 Kohno

FOREIGN PATENT DOCUMENTS

JP 2010-060734 A 3/2010
JP 2010-139603 A 6/2010
JP 2017-167217 A 9/2017

* cited by examiner

*Primary Examiner* — Francis C Gray
(74) *Attorney, Agent, or Firm* — Venable LLP

(57) ABSTRACT

An image forming apparatus includes a belt, an outer roller, stretching rollers including an inner roller and an upstream roller, a voltage source, a supporting member, a moving mechanism, a sensor, and a controller. On the basis of a first detection result of the sensor acquired under application of a test bias in a state in which the supporting member is disposed at a first position, the controller determines a first transfer bias to be applied to the outer roller or the inner roller during an operation in a first mode. On the basis of a second detection result of the sensor acquired under application of the test bias in the state in which the supporting member is disposed at a second position, the controller determines a second transfer bias to be applied to the outer roller or the inner roller during an operation in a second mode.

26 Claims, 12 Drawing Sheets

(a)

(b)

(a)

(b)

IMAGE FORMING APPARATUS

FIELD OF THE INVENTION AND RELATED ART

The present invention relates to an image forming apparatus, such as a copying machine, a printer or a facsimile machine, of an electrophotographic type or an electrostatic recording type.

Conventionally, for example, as the image forming apparatus of the electrophotographic type, there is an intermediary transfer type including an intermediary transfer belt which is constituted by an endless belt. The image forming apparatus of the intermediary transfer type has a feature such that the image forming apparatus is suitable for forming images on various kinds of recording materials, but is required to further form images on paper with a large basis weight and paper with low smoothness, and the like.

Onto the paper having low smoothness, a toner image is not readily transferred from the intermediary transfer belt. In the case where unevenness (projections and recesses) of several 10 μm or more exists on the surface of the paper, even in a constitution in which a secondary transfer bias is applied while pressing the paper against the intermediary transfer belt by a secondary transfer member constituted by, e.g., an electroconductive rubber roller, at a recessed portion of the paper, the intermediary transfer belt and the paper cannot contact each other and a gap therebetween is liable to be formed. When the secondary transfer bias is applied, electric discharge occurs at the portion where the gap is formed. When the toner image on the intermediary transfer belt is subjected to the electric discharge in the neighborhood of a secondary transfer nip formed by the intermediary transfer belt and the secondary transfer member, the toner of the toner image is electrically discharged or electrically charged, so that a charge amount distribution of the toner on the intermediary transfer belt is broadened, with the result that a transfer property is impaired. By this, a part of the toner image on the intermediary transfer belt is not properly transferred in some instances (transfer void). Further, a similar phenomenon occurs also in the case where the rotating intermediary transfer belt is unstable in attitude due to vibration or waving in the neighborhood of the secondary transfer nip. This is also true for the case where the attitude of the photosensitive drum is unstable in the neighborhood of the secondary transfer nip. That is, when an adhesive property between the paper and the intermediary transfer belt is impaired, the charge amount distribution of the toner on the intermediary transfer belt is broken by the electric discharge generated in the neighborhood of the secondary transfer nip, so that the toner which does not follow an electrostatic force acting on the paper at the secondary transfer nip increases and thus a transfer property of the toner image onto the paper is impaired.

In order to solve the problems, provision of a supporting member for holding an attitude of the intermediary transfer belt from an inner peripheral surface side of the intermediary transfer belt in the neighborhood of an upstream side of the secondary transfer portion with respect to a rotational direction of the intermediary transfer belt is effective (Japanese Laid-Open Patent Application 2010-139603). By the supporting member, vibration and waving of the intermediary transfer belt are suppressed, and therefore, the electric discharge on the side upstream of the secondary transfer nip is suppressed.

However, when the supporting member for holding the attitude of the intermediary transfer belt from the inner peripheral surface side of the intermediary transfer belt in the neighborhood of the upstream side of the secondary transfer nip is provided, the following phenomenon that the toner image is disturbed occurs in some instances. That is, when a leading end of the recording material with respect to a feeding direction enters the secondary transfer nip or when a trailing end of the recording material comes out of the secondary transfer nip, the recording material and the intermediary transfer belt are not temporarily in intimate contact with each other. As a result, for example, the toner on the intermediary transfer belt is subjected to abnormal electric discharge generated due to separation between the recording material and the intermediary transfer belt and a charge polarity of the toner on the intermediary transfer belt is reversed, so that the toner is not transferred onto the recording material in some cases (white void). This phenomenon will be further described. The intermediary transfer belt is stretched by a plurality of stretching rollers. The secondary transfer nip is a contact portion between an outer peripheral surface of the intermediary transfer belt and an outer roller disposed opposed to an inner roller which is one of the stretching rollers. When the recording material is sandwiched between the intermediary transfer belt and the other roller in the secondary transfer nip, the recording material causes a force, with respect to a direction toward an inner peripheral surface of the intermediary transfer belt, to act on a surface of the intermediary transfer belt on a side upstream of the secondary transfer nip. In a cross-section substantially perpendicular to a rotational axis direction of the inner roller, a direction (line) perpendicular to a line connecting a rotation center of the outer roller and a rotation center of the inner roller is defined as a nip line (part (a) of FIG. 13). As long as the recording material is in a state in which the recording material is sandwiched between the outer roller and the intermediary transfer belt in the secondary transfer nip, an attitude of the recording material is to be maintained substantially along the nip line. However, a status is different between when the leading end of the recording material enters the secondary transfer nip and when the trailing end of the recording material comes out of the secondary transfer nip.

When the leading end of the recording material is about to reach the secondary transfer nip, the recording material and the intermediary transfer belt form a certain angle therebetween, and therefore, at the instant when the recording material enters the secondary transfer nip and is sandwiched between the intermediary transfer belt and the outer roller, an attitude of the recording material is likely to change so as to extend along the nip line. At that time, the recording material causes the force to act on the intermediary transfer belt surface in a direction in which the intermediary transfer belt surface is pushed up toward the inner peripheral surface side, so that the intermediary transfer belt moves in a direction away from the recording material.

Further, when the trailing end of the recording material comes out of the secondary transfer nip, the trailing end of the recording material is separated from a guiding member positioned on a side upstream of the secondary transfer nip, and a force along the nip line acts on the recording material at a portion of the recording material from the secondary transfer nip to the trailing end of the recording material. Particularly, in a constitution in which a width of the secondary transfer nip (i.e., width with respect to a surface movement direction of the intermediary transfer belt) is extended toward a side upstream of a width of a contact region between the inner roller and the intermediary transfer belt (i.e., width with respect to the surface movement direction of the intermediary transfer belt), the nip line bites into the intermediary transfer belt surface. For that reason, the portion in the neighborhood of the trailing end of the recording material pushes up the surface of the intermediary transfer belt toward the inner peripheral surface side, so that the intermediary transfer belt behaves so that the intermediary transfer belt and the recording material separate from each other as shown in part (b) of FIG. 13. Incidentally, the constitution in which the width of the secondary transfer nip is broadened toward a side upstream of the width of the contact region between the inner roller and the intermediary transfer belt is a constitution in which the outer roller is disposed on a side upstream of the inner roller or a constitution in which the width of the secondary transfer nip is broader than the width of the contact region between the inner roller and the intermediary transfer belt.

As described above, when the leading end of the recording material enters the secondary transfer nip and when the trailing end of the recording material comes out of the secondary transfer nip, the force acts on the intermediary transfer belt in the inner peripheral surface direction. In this case, when the supporting member as described above is provided, depending on an amount in which the intermediary transfer belt is projected toward the outer peripheral surface side by the supporting member, the intermediary transfer belt is liable to form nodes for a short loop (part (c) of FIG. 13). For that reason, when the leading end of the recording material enters the secondary transfer nip, the portion in the neighborhood of the recording material exhibits behavior such that the portion contacts the intermediary transfer belt and separates from the intermediary transfer belt, and then contacts the intermediary transfer belt again. That is, the recording material once contacts the intermediary transfer belt before the recording material reaches the secondary transfer nip. However, at the instance when the recording material enters the secondary transfer nip, the recording material separates from the intermediary transfer belt. Then, when the leading end of the recording material reaches a central portion of the secondary transfer nip, the above-described loop is eliminated, so that the recording material and the intermediary transfer belt 5 extend in the same direction. In this process, the toner at a portion in the neighborhood of the leading end of the recording material is scattered on a white background portion in some cases (scattering or white flower). Particularly, in a halftone image, this tendency is conspicuous, and the toner scatters onto the white background portion surrounding a dot image, so that the image becomes a blur image.

Further, in this process, the toner on the intermediary transfer belt to be transferred onto the recording material is subjected to abnormal (electric) discharge, and the charge polarity of the toner is reversed, so that the toner is not transferred onto the recording material in some instances (white void). Further, also at a portion in the neighborhood of the trailing end of the recording material, similarly as in the above case, the portion where the recording material and the intermediary transfer belt separate from each other generates. Further, the toner on the intermediary transfer belt to be transferred onto the recording material is subjected to the abnormal discharge, and the charge polarity of the toner is reversed, so that the toner is not transferred onto the recording material in some instances (white void). Further, also at the portion in the neighborhood of the trailing end of the recording material, similarly as in the case of the portion in the neighborhood of the leading end of the recording material, "scattering" generates in some cases.

Such a phenomenon is conspicuous in the case of a recording material, such as thick paper (both of coated paper and non-coated paper) which has relatively high stiffness with a certain thickness or more.

In order to solve such a problem, it is effective that a position of the above-described supporting member provided for stabilizing the attitude of the intermediary transfer belt is made changeable. However, when the position of this supporting member is changed, excess and deficiency of the transfer bias occurs, so that the toner image cannot be properly transferred from the intermediary transfer belt onto the recording material in some instances. When the secondary transfer bias is excessively low, a transfer current enough to transfer the toner image from the intermediary transfer belt onto the recording material cannot be obtained, so that improper transfer occurs. Further, even when the secondary transfer bias is excessively high, reversal of the toner charge polarity on the intermediary transfer belt is caused by the electric discharge and thus the toner image is not transferred onto the recording material and so on, with the result that the improper transfer occurs.

SUMMARY OF THE INVENTION

A principal object of the present invention is to provide an image forming apparatus capable of suppressing improper transfer due to excess and deficiency of a transfer bias even in a constitution in which a position of a supporting member is changeable.

According to an aspect of the present invention, there is provided an image forming apparatus comprising: an endless belt configured to carry a toner image transferred at a first transfer position; an outer roller contacting an outer peripheral surface of the belt and configured to transfer the toner image from the belt onto a recording material at a secondary transfer position; a plurality of stretching rollers configured to stretch the belt, wherein the stretching rollers includes an inner roller provided correspondingly to the secondary transfer position and includes an upstream roller provided on a side downstream of the first transfer position and upstream of the inner roller with respect to a rotational direction of the belt; a voltage source configured to apply a transfer bias, to the outer roller or the inner roller, for transferring the toner image from the belt onto the recording material; a supporting member contactable to an inner peripheral surface of the belt on a side upstream of the inner roller and downstream of the upstream roller with respect to the rotational direction of the belt; a moving mechanism configured to move the supporting member between a first position and a second position different from the first position in a cross-section substantially perpendicular to a rotational axis direction of the inner roller; a sensor configured to detect a current value or a voltage value when a bias is applied from the voltage source to the outer roller or the inner roller; and a controller capable of executing an operation in a first mode in which an image is formed on the recording material in a state in which the supporting member is disposed at the first position and an operation in a second mode in which the image is formed on the recording material in a state in which the supporting member is disposed at the second position, and capable of executing an operation in a test mode in which during non-image formation, the transfer bias is adjusted on the basis of a detection result of the sensor acquired under application of a test bias from the voltage source to the outer roller or the inner roller, wherein on the basis of a first detection result of the sensor acquired under application of the test bias in the state in which the supporting member is disposed at the first position, the controller determines a first transfer bias applied from the voltage source to the outer roller or the inner roller during the operation in the first mode, and on the basis of a second detection result of the sensor acquired under application of the test bias in the state in which the supporting member is disposed at the second position, the controller determines a second transfer bias applied from the voltage source to the outer roller or the inner roller during the operation in the second mode.

According to another aspect of the present invention, there is provided an image forming apparatus comprising: an endless belt configured to carry a toner image transferred at a first transfer position; an outer roller contacting an outer peripheral surface of the belt and configured to transfer the toner image from the belt onto a recording material at a secondary transfer position; a plurality of stretching rollers configured to stretch the belt, wherein the stretching rollers includes an inner roller provided correspondingly to the secondary transfer position and includes an upstream roller provided on a side downstream of the first transfer position and upstream of the inner roller with respect to a rotational direction of the belt; a voltage source configured to apply a transfer bias, to the outer roller or the inner roller, for transferring the toner image from the belt onto the recording material; a supporting member contactable to an inner peripheral surface of the belt on a side upstream of the inner roller and downstream of the upstream roller with respect to the rotational direction of the belt; a moving mechanism configured to move the supporting member between a first position and a second position different from the first position in a cross-section substantially perpendicular to a rotational axis direction of the inner roller; a sensor configured to detect a current value or a voltage value when a bias is applied from the voltage source to the outer roller or the inner roller; and a controller capable of executing an operation in a first mode in which an image is formed on the recording material in a state in which the supporting member is disposed at the first position and an operation in a second mode in which the image is formed on the recording material in a state in which the supporting member is disposed at the second position, and capable of executing an operation in a test mode in which during non-image formation, the transfer bias is adjusted on the basis of a detection result of the sensor acquired under application of a test bias from the voltage source to the outer roller or the inner roller, wherein on the basis of a detection result of the sensor acquired under application of the test bias in the state in which the supporting member is disposed at the first position, the controller determines a first transfer bias applied from the voltage source to the outer roller or the inner roller during the operation in the first mode, and determines a second transfer bias applied from the voltage source to the outer roller or the inner roller during the operation in the second mode.

Further features of the present invention will become apparent from the following description of exemplary embodiments with reference to the attached drawings.

Figure 2:
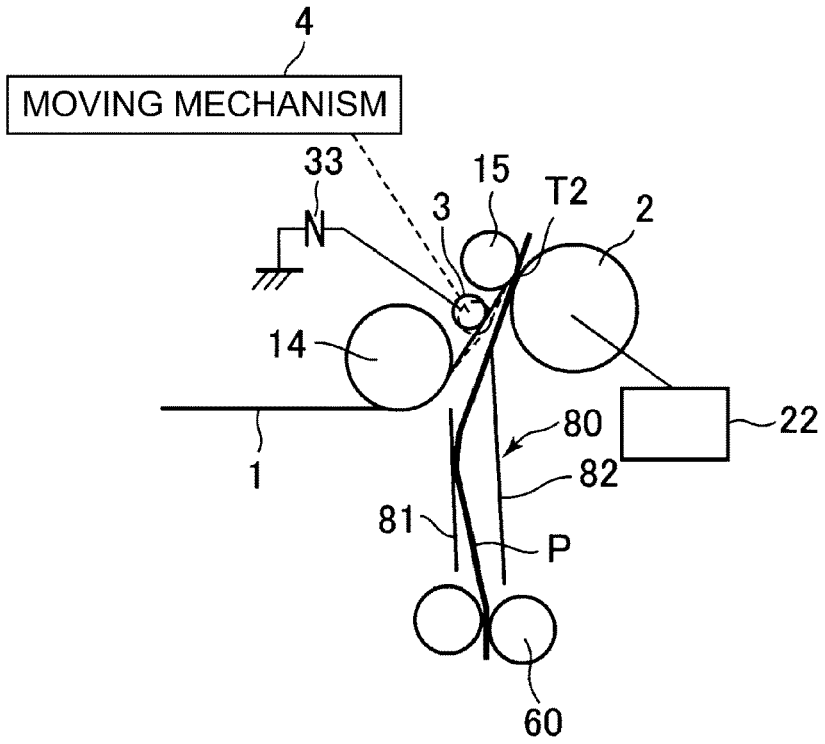
Figure 2:
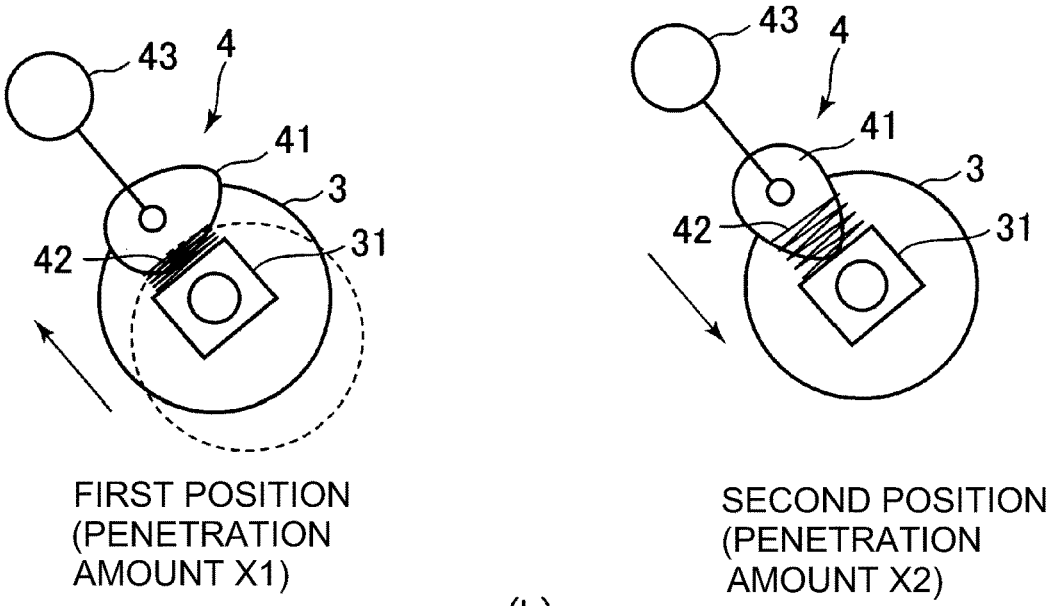

Part (a) of FIG. 2 is a schematic sectional view of a neighborhood of a secondary transfer portion, and part (b) of FIG. 2 is a schematic structural view of a moving mechanism.

Figure 3:
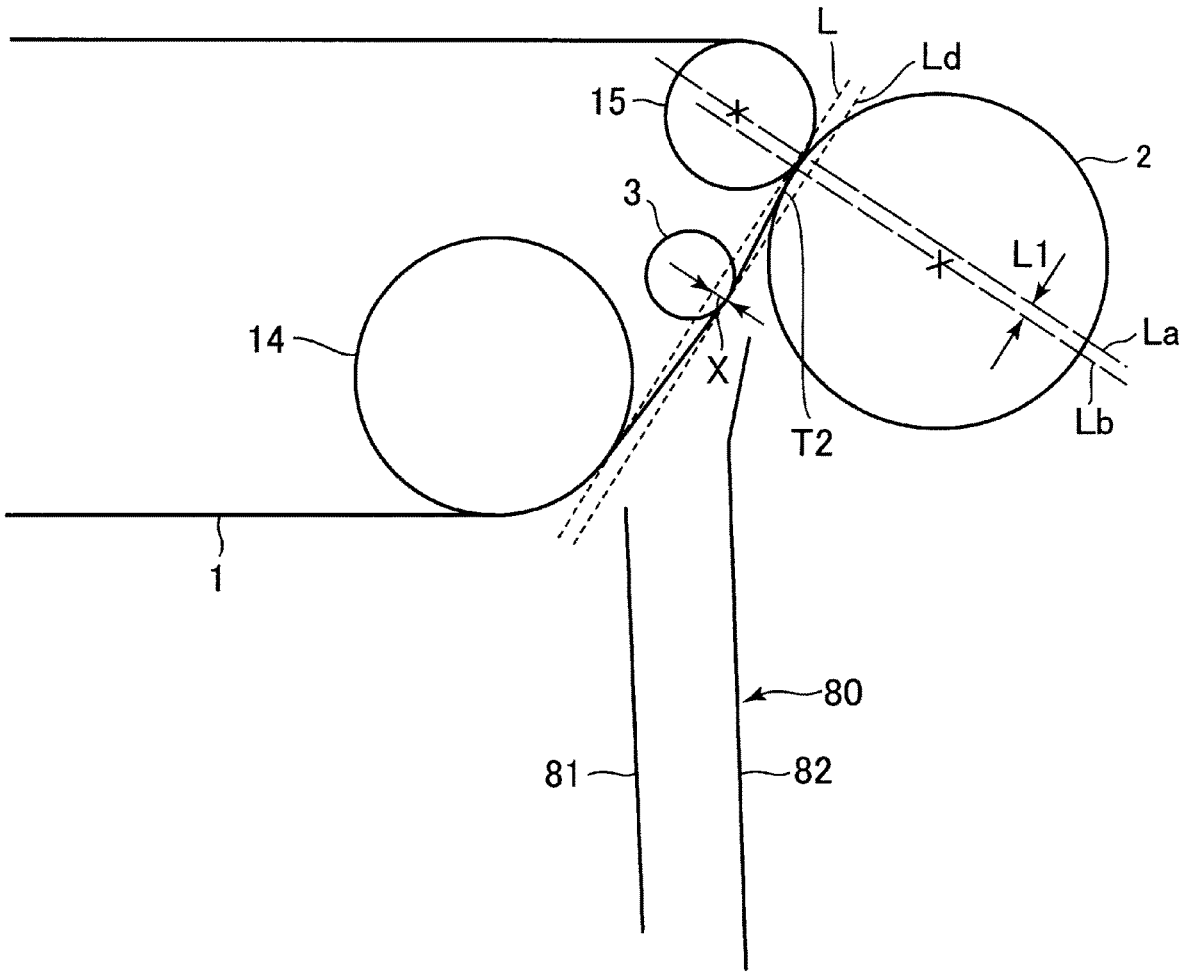

FIG. 3 is a schematic sectional view of a neighborhood of the secondary transfer portion.

Figure 4:
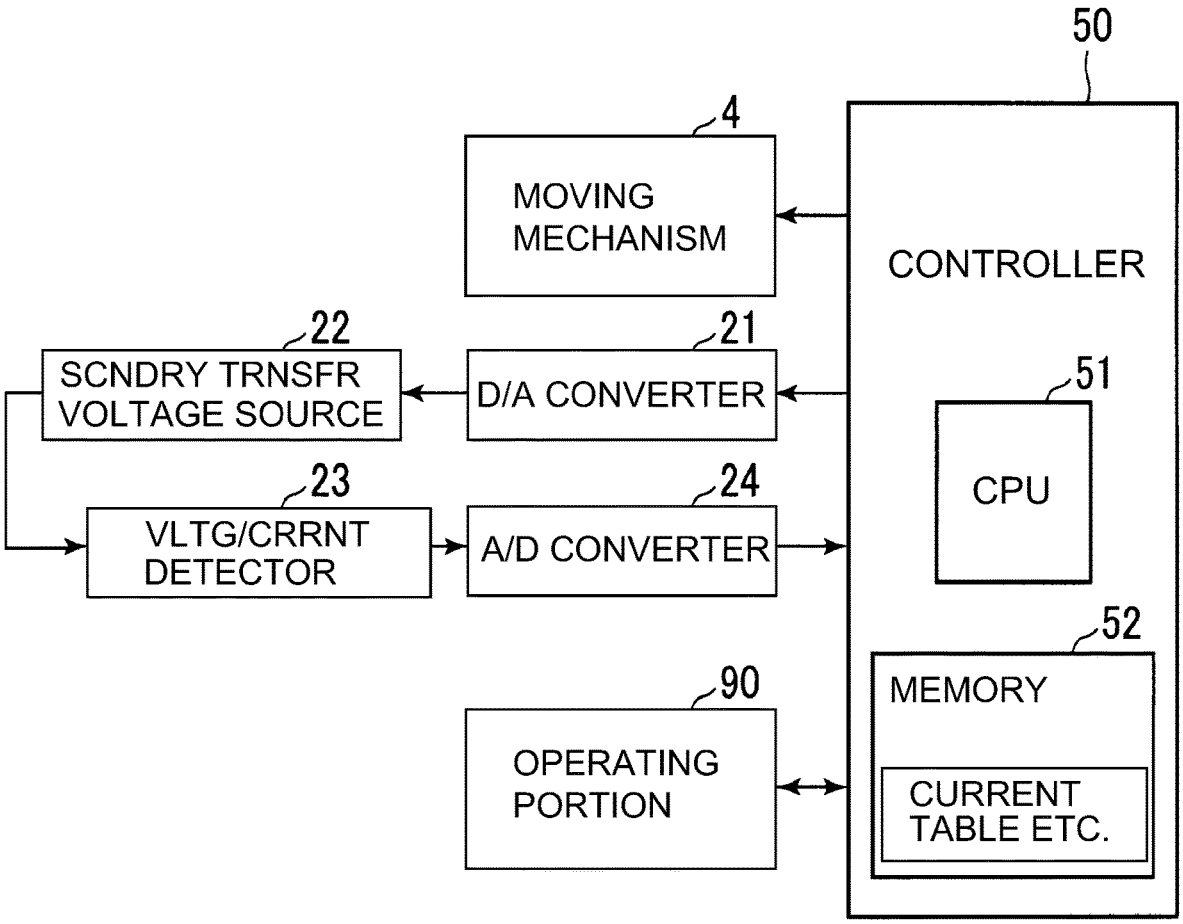

FIG. 4 is a schematic block diagram showing a control mode of a principal part of the image forming apparatus.

Figure 5:
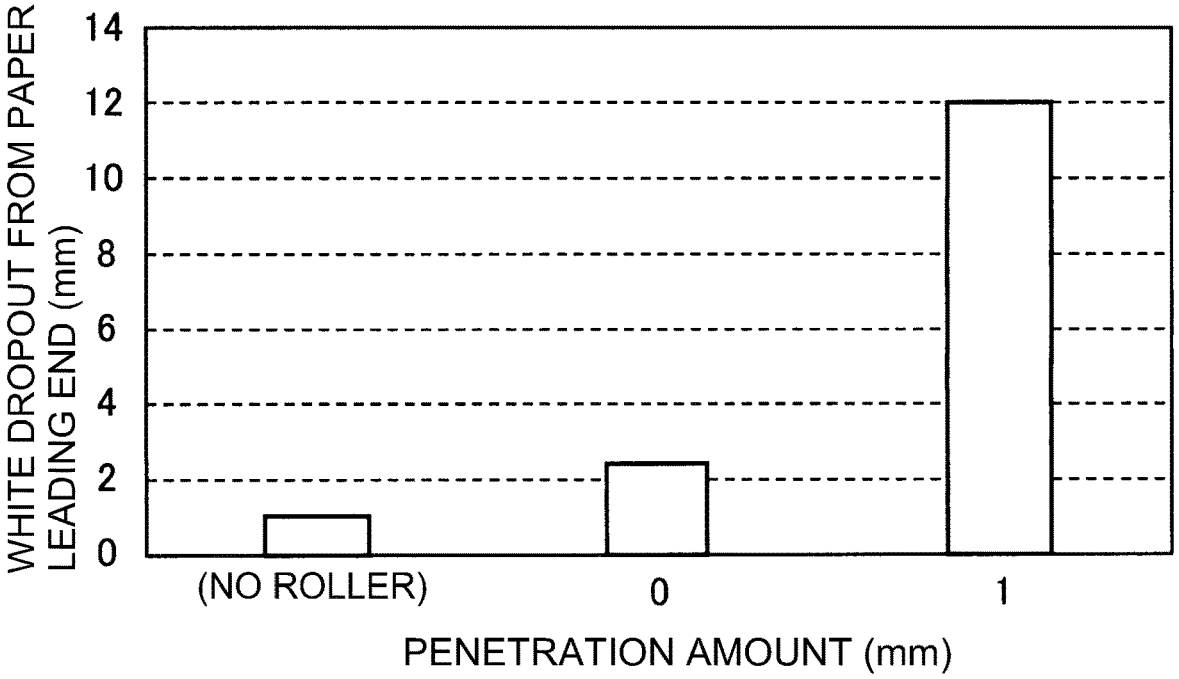

FIG. 5 is a graph showing a relationship between a penetration amount and a white void distance.

Figure 6:
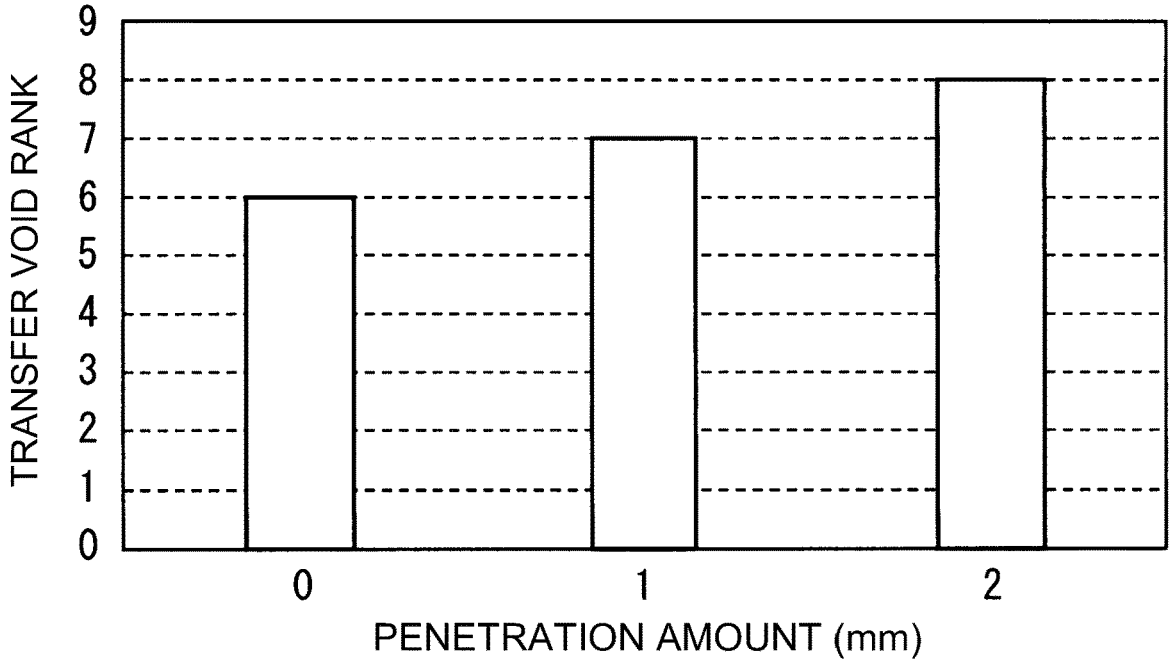

FIG. 6 is a graph showing a relationship between the penetration amount and a rank of transfer void.

Figure 7:
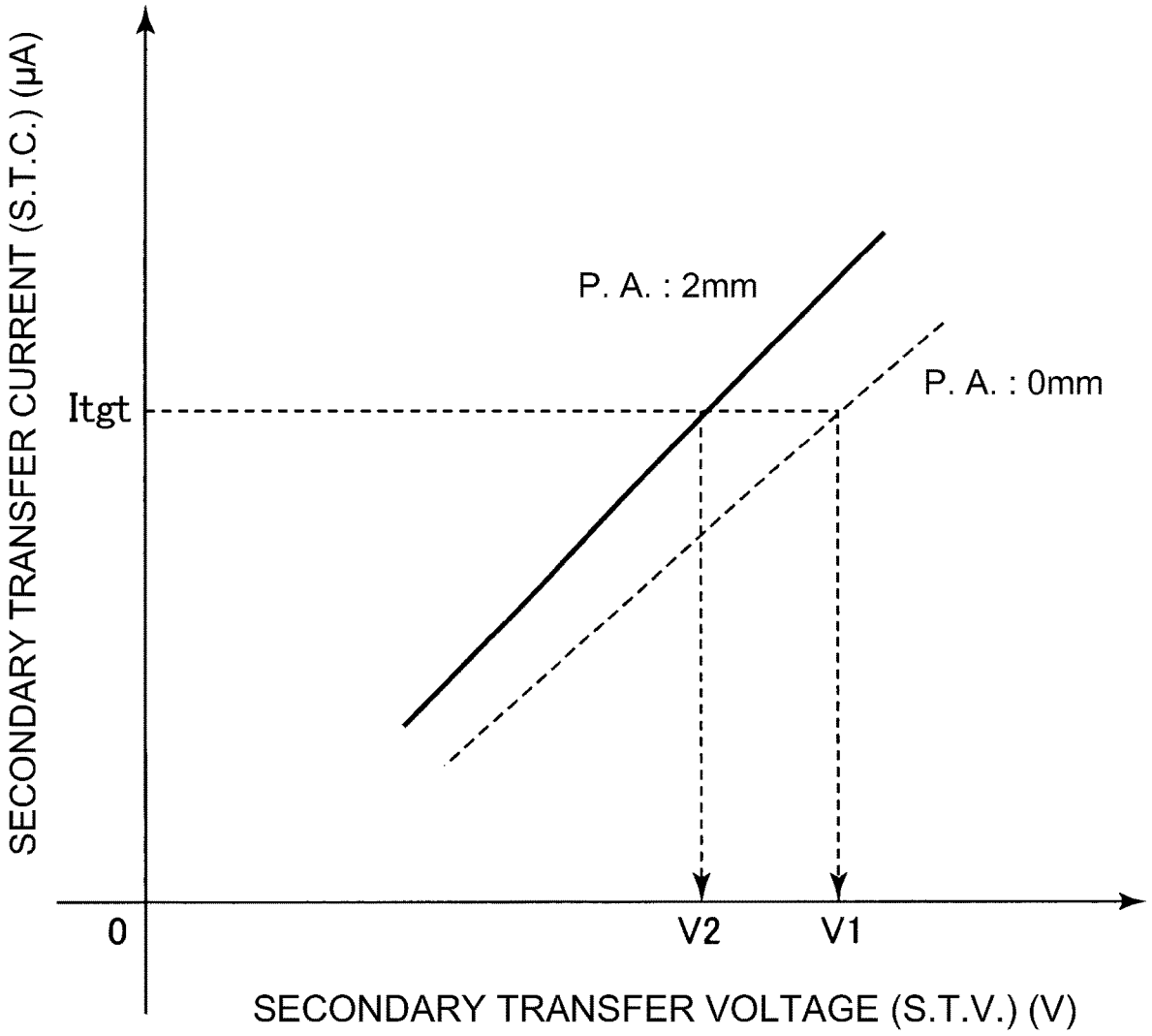

FIG. 7 is a graph showing voltage-current characteristics of the secondary transfer portion.

Figure 8:
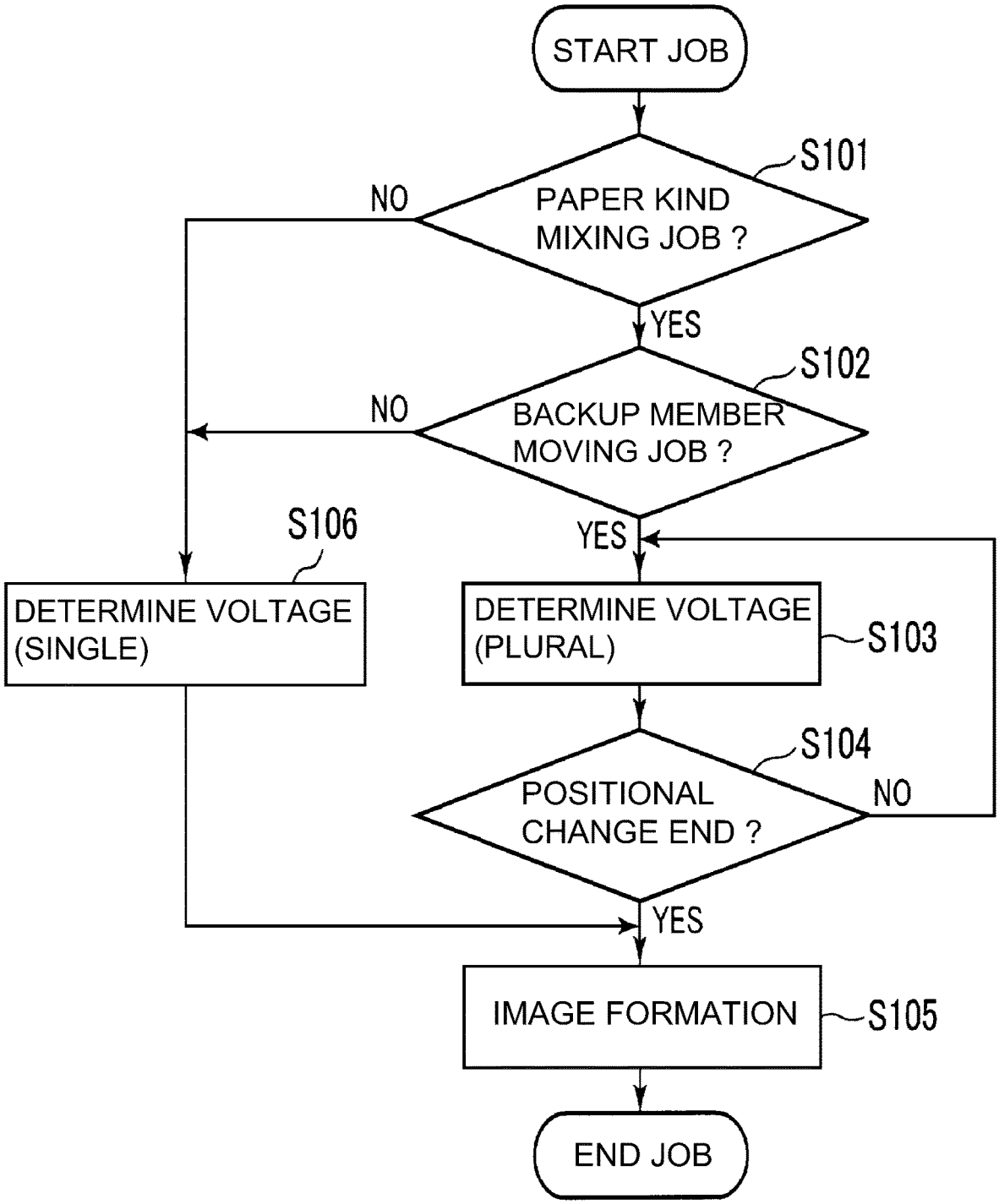

FIG. 8 is a flowchart showing a schematic procedure of control in Embodiment 1.

Figure 9:
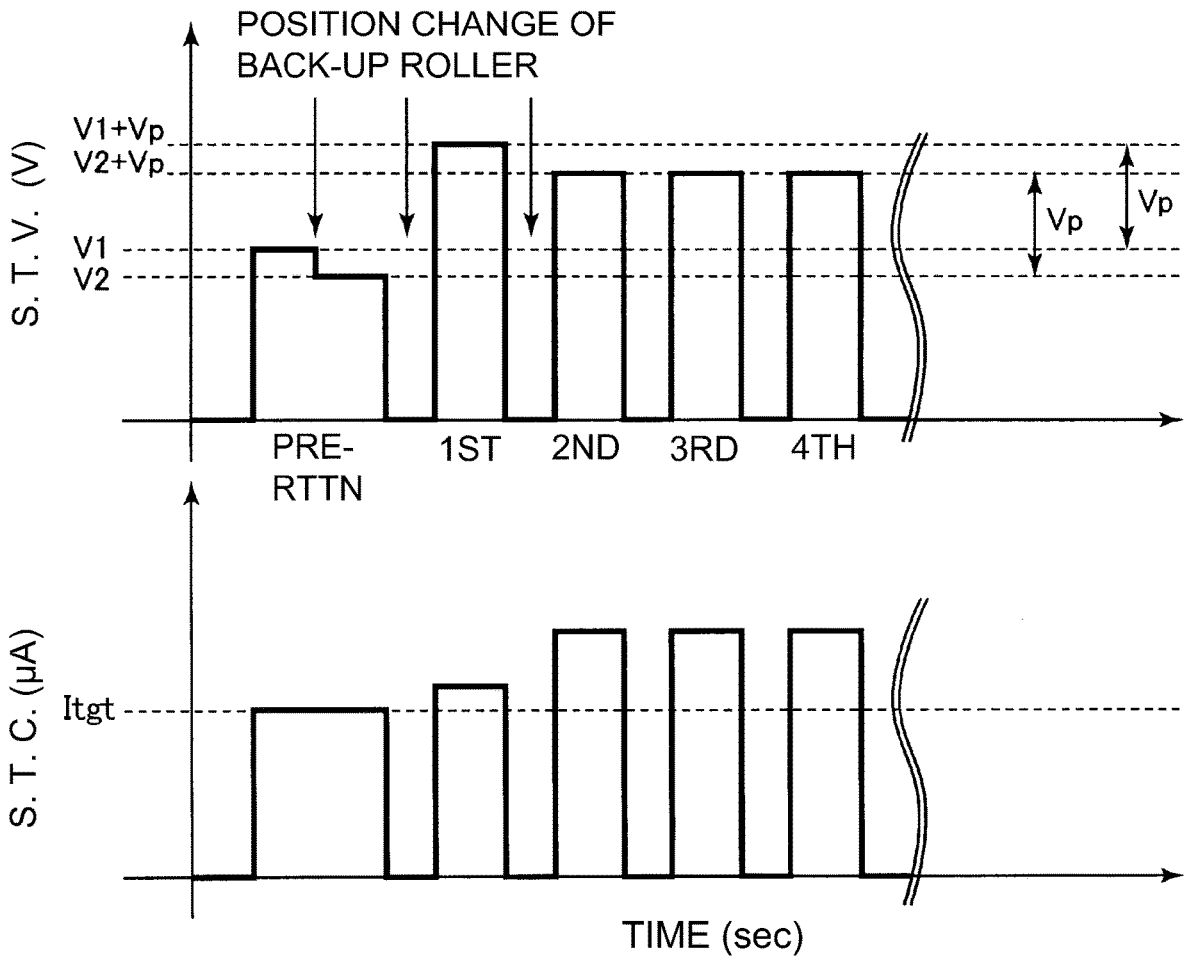

FIG. 9 includes time charts showing examples of a voltage waveform and a current waveform.

Figure 10:
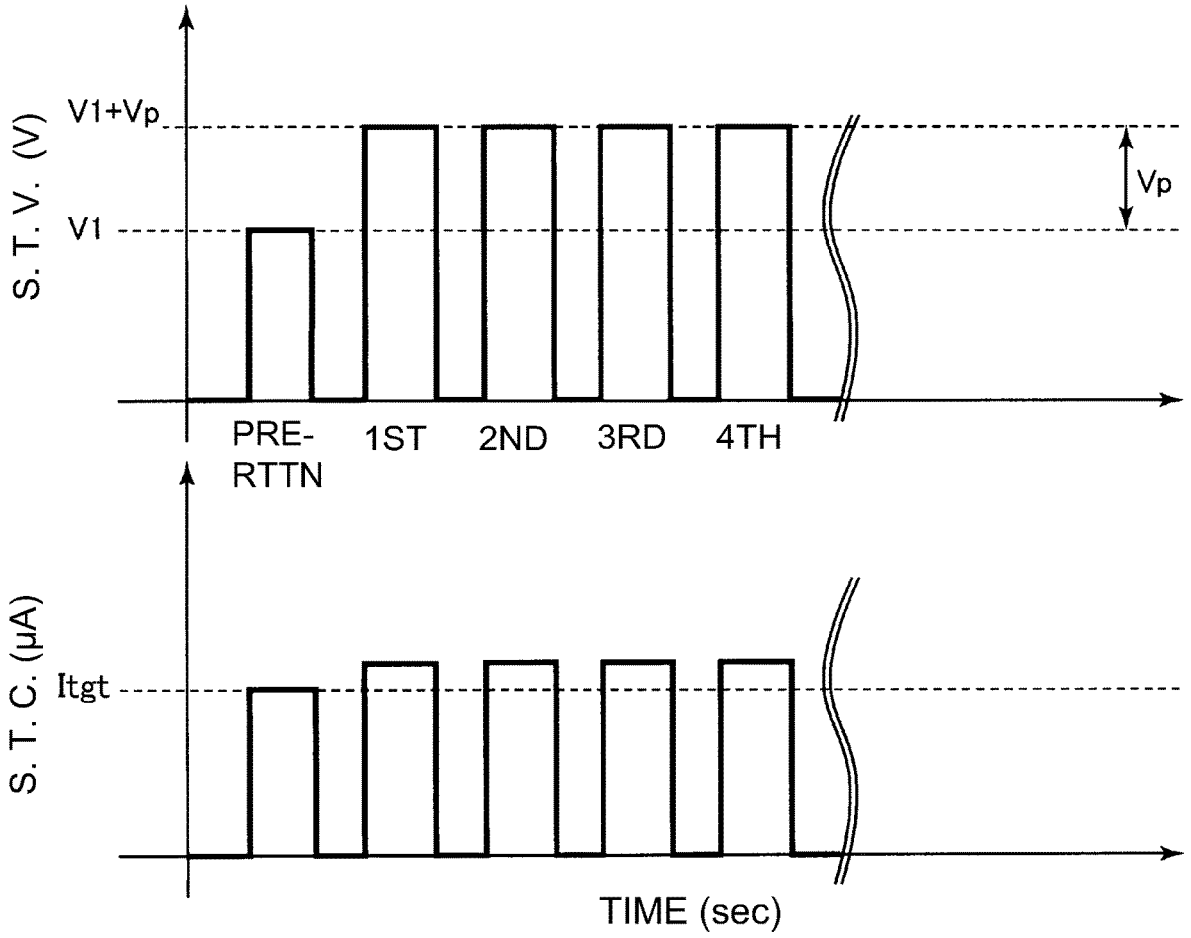

FIG. 10 includes time charts showing other examples of the voltage waveform and the current waveform.

Figure 11:
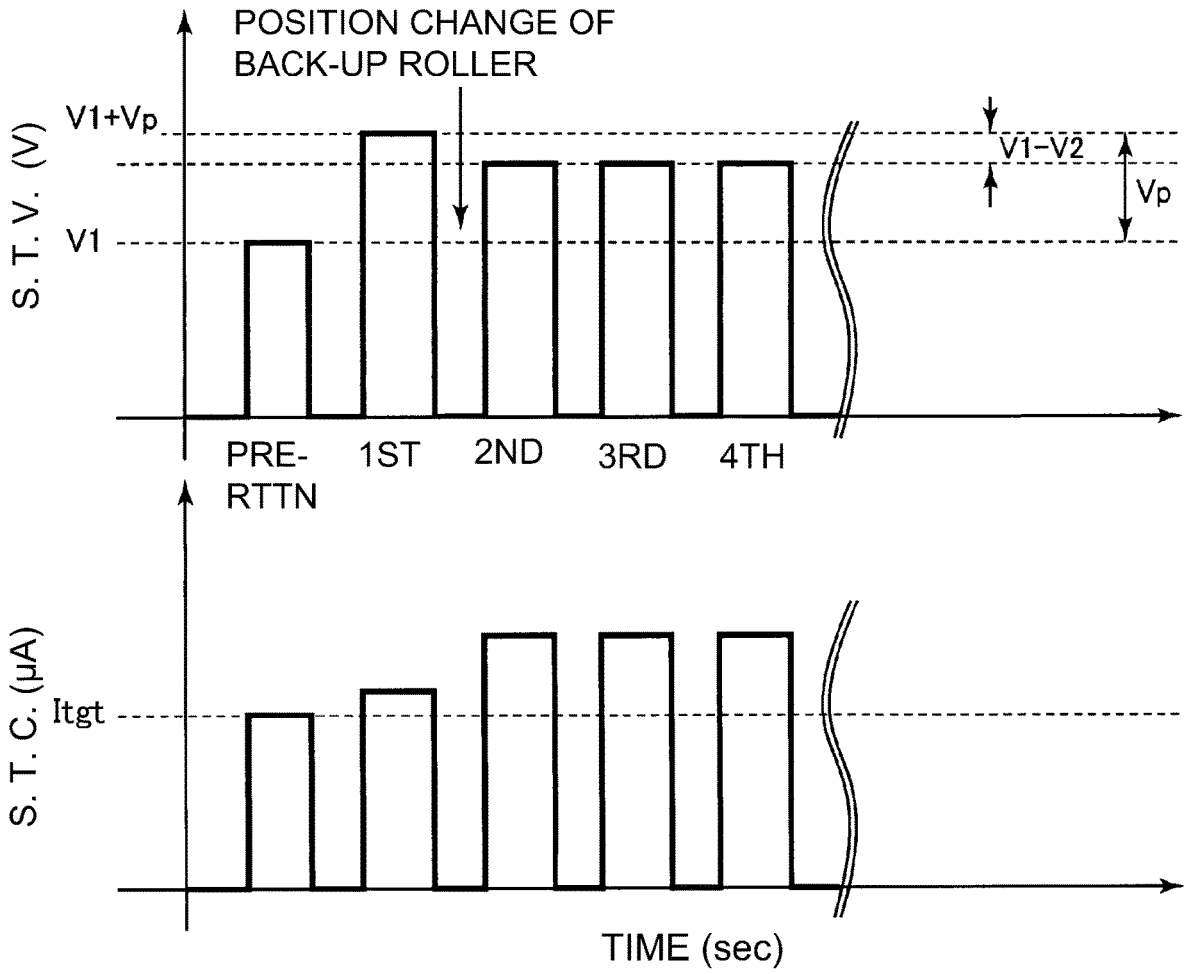

FIG. 11 includes time charts showing examples of a voltage waveform and a current waveform in Embodiment 2.

Figure 12:
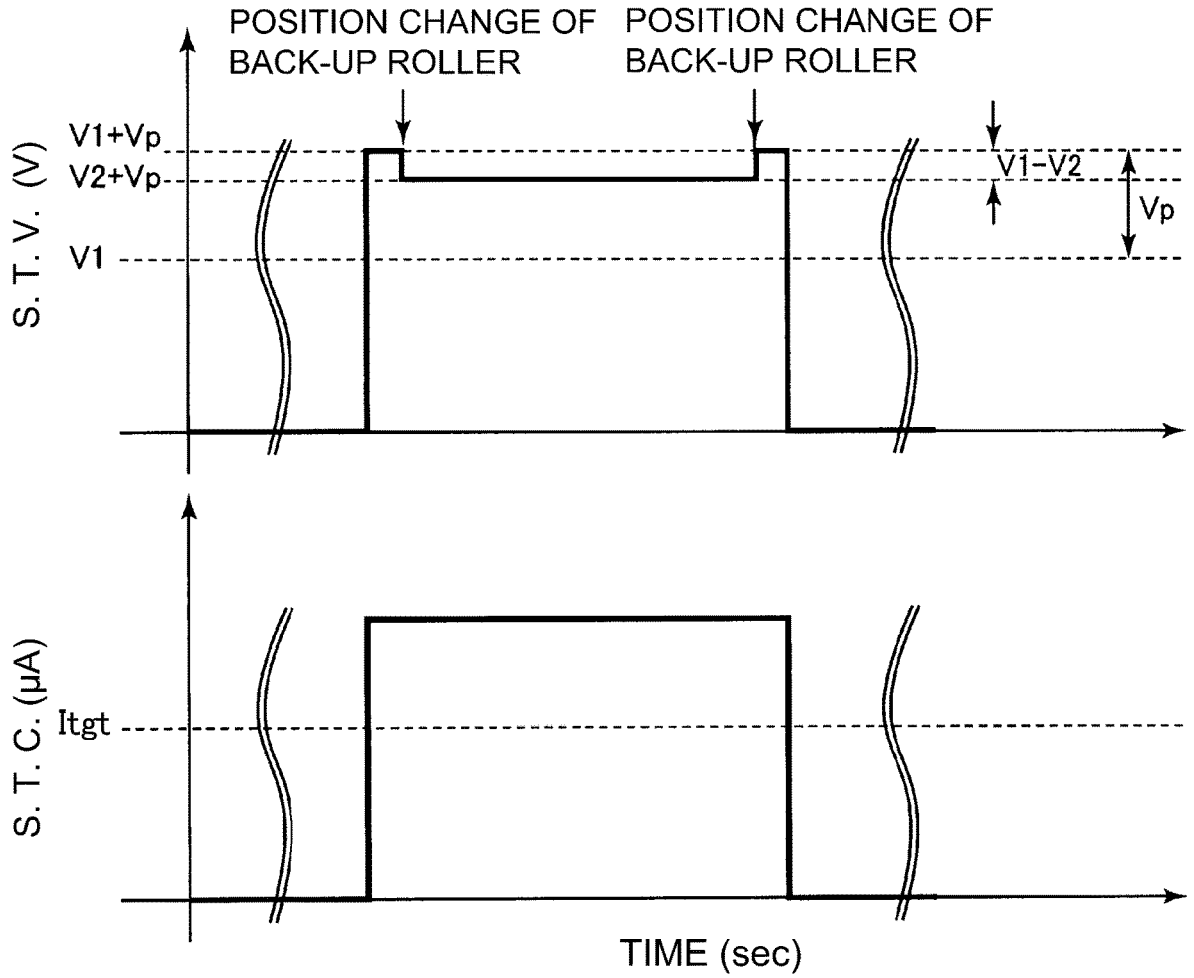

FIG. 12 includes time charts showing other examples of a voltage waveform and a current waveform in Embodiment 3.

Figure 13:
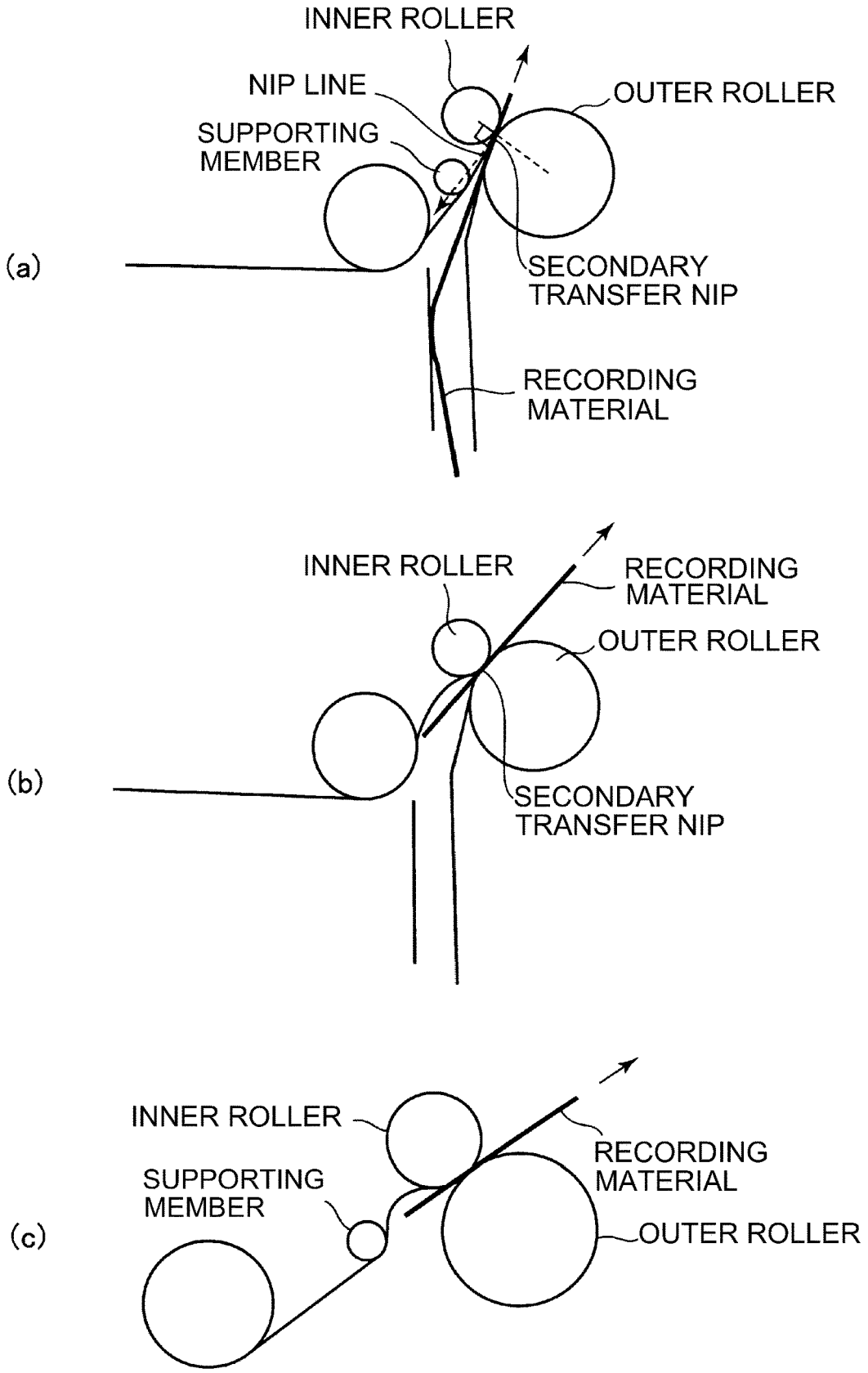

Parts (a), (b) and (c) of FIG. 13 are schematic sectional views of a neighborhood of the secondary transfer portion, for illustrating a problem.

DESCRIPTION OF THE EMBODIMENTS

An image forming apparatus according to the present invention will be specifically described with reference to the drawings.

Embodiment 1

1. General Constitution and Operation of Image Forming Apparatus

Figure 1:
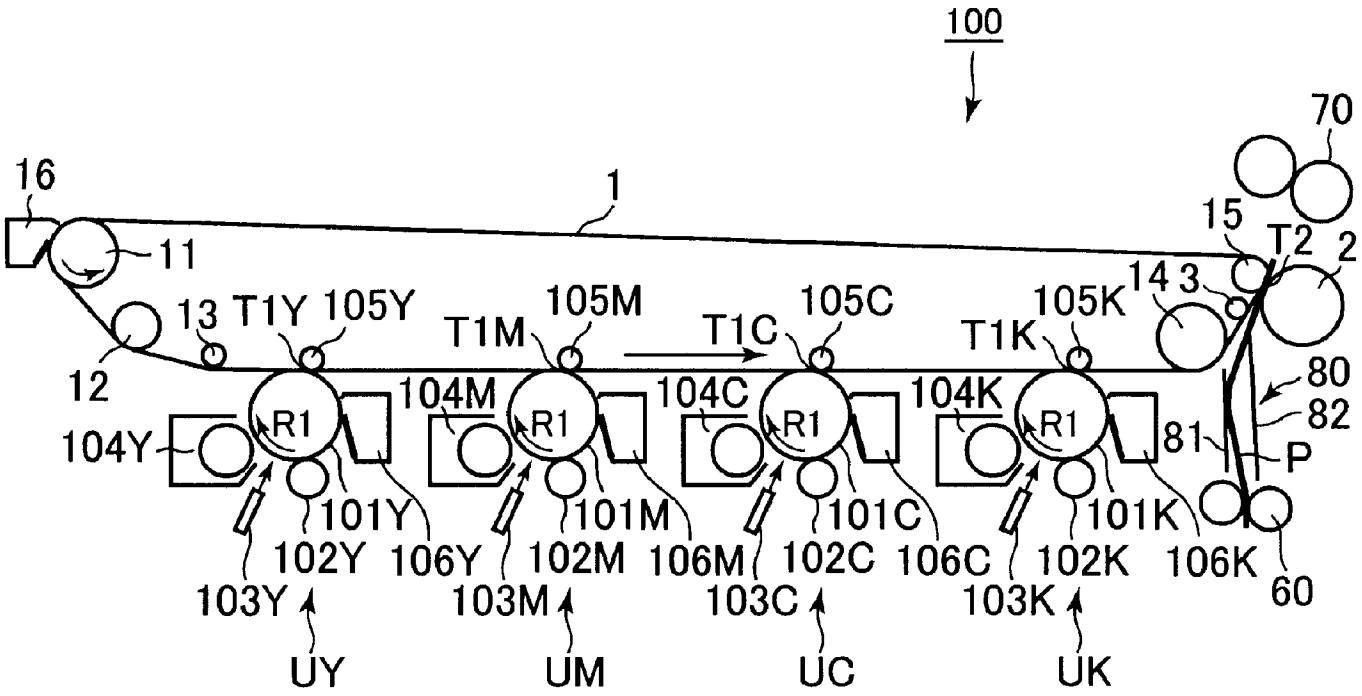
FIG. 1 is a schematic sectional view of an image forming apparatus.

FIG. 1 is a schematic sectional view of an image forming apparatus 100 of the present invention.

The image forming apparatus 100 in this embodiment is a tandem multi-function machine (having functions of a copying machine), a printer and a facsimile machines) which is capable of forming a full-color image using an electrophotographic type process and which employs an intermediary transfer type process.

The image forming apparatus 100 includes, as a plurality of image forming portions (stations), first to fourth image forming units UY, UM, UC and UK for forming images of yellow (Y), magenta (M), cyan (C) and black. As regards elements of the first to fourth image forming units UY, UM, UC and UK having the same or corresponding functions or constitutions, suffixes Y, M, C and K for representing the elements for associated colors are omitted, and the elements will be collectively described in some instances.

The image forming unit U includes the photosensitive drum 101 which is a rotatable drum-shaped (cylindrical) photosensitive member (electrophotographic photosensitive member) as a first image bearing member. The photosensitive drum 101 is rotationally driven at a predetermined peripheral speed in an arrow R1 direction (clockwise direction). The image forming unit is constituted by a photosensitive drum 101, a charging roller 102, an exposure device 103, a developing device 104, a primary transfer roller 105, a drum cleaning device 106 and the like, which are described later.

A surface of the rotating photosensitive drum 101 is electrically charged uniformly to a predetermined polarity (negative in this embodiment) and a predetermined potential by the charging roller 102 which is a roller-type charging member as a charging means. The charged photosensitive drum 101 is subjected to scanning exposure to light by the exposure device (laser scanner) 103 as an exposure means, so that an electrostatic image (electrostatic latent image) is formed on the photosensitive drum 101. The electrostatic image formed on the photosensitive drum 101 is developed (visualized) by supplying toner as a developer by the developing device 104 as a developing means, so that a toner image (developer image) is formed on the photosensitive drum 101. In this embodiment, the toner charged to the same polarity as a charge polarity of the photosensitive drum 101 is deposited on an exposed portion (image portion) of the photosensitive drum 101 where an absolute value of the potential is lowered by exposing to light the surface of the photosensitive drum 101 after the photosensitive drum 101 is uniformly charged.

As a second image bearing member, an intermediary transfer belt 1, which is a rotatable intermediary transfer member constituted by an endless belt, is provided so as to oppose the four photosensitive drums 101. The intermediary transfer belt 1 is extended around and stretched by a plurality of stretching rollers including a driving roller 11, a tension roller 12, first and second idler rollers 13 and 14 and an inner secondary transfer roller 15. The intermediary transfer belt 1 is rotated (circulated or moved) in an arrow direction (counterclockwise direction) in FIG. 1 by transmission of a driving force from the driving roller 11 thereto. On the inner peripheral surface side of the intermediary transfer belt 1, the primary transfer rollers 105 which are roller-type primary transfer members as primary transfer means are disposed correspondingly to the respective photosensitive drums 101. Each primary transfer roller 105 is urged toward an associated photosensitive drum 101 through the intermediary transfer belt 1, whereby a primary transfer portion (primary transfer nip) T1 where the photosensitive drum 101 and the intermediary transfer belt 1 contact each other is formed.

The toner image formed on the photosensitive drum 101 as described above is primary-transferred onto the rotating intermediary transfer belt 1 at the primary transfer portion T1. During the primary transfer step, to the primary transfer roller 105, a primary transfer bias (primary transfer voltage) which is a DC voltage of an opposite polarity (positive in this embodiment) to a normal charge polarity (the charge polarity of the toner during the development) of the toner is applied by an unshown primary transfer voltage source (high voltage source). For example, during full-color image formation, the color toner images of Y, M, C and K formed on the respective photosensitive drums 101 are successively primary-transferred supposedly onto the intermediary transfer belt 5 at the respective primary transfer portions T1.

On an outer peripheral surface side of the intermediary transfer belt 1, at a position opposing the inner secondary transfer roller 15, an outer secondary transfer roller 2 which is a roller-type secondary transfer member as a secondary transfer means is provided. The outer secondary transfer roller 2 is urged toward the inner secondary transfer roller 15 through the intermediary transfer belt 1 and forms a secondary transfer portion (secondary transfer nip) T2 where the intermediary transfer belt 1 and the outer secondary transfer roller 2 contact each other. The toner images formed on the intermediary transfer belt 1 as described above are secondary-transferred onto a recording material (recording medium, sheet) P such as paper sandwiched and fed by the intermediary transfer belt 1 and the outer secondary transfer roller 2 at the secondary transfer portion T2. In this embodiment, during the secondary transfer step, to the outer secondary transfer roller 2, a secondary transfer bias which is a DC voltage of the opposite polarity (positive in this embodiment) to the normal charge polarity of the toner is applied by a secondary transfer voltage source (high voltage source) 22 (part (a) of FIG. 2).

The recording material P is fed one by one from a recording material accommodating portion (not shown) by a pick-up roller (not shown) and then is fed by a feeding roller pair (not shown). Thereafter, this recording material P is fed toward the secondary transfer portion T2 by being timed to the toner images on the intermediary transfer belt 1 by a registration roller pair 60 as a feeding member. With respect to a feeding direction of the recording material P, a guiding member 80 for guiding the recording material P to the secondary transfer portion T2 is provided downstream of the registration roller pair 60 and upstream of the secondary transfer portion T2. The guiding portion 80 is constituted by including a first guiding member 81 contactable to a front surface of the recording material P (i.e., a surface onto which the toner image is to be transferred immediately after the recording material P passes through the guiding portion 80) and a second guiding member 82 contactable to a back surface of the recording material P (i.e., a surface opposite from the front surface). The image guiding member 81 and the second guiding member 82 are disposed opposed to each other, and the recording material P passes through between these members. The first guiding member 81 regulates movement of the recording material P in a direction toward the intermediary transfer belt 1. The second guiding member 82 regulates movement of the recording material P in a direction away from the intermediary transfer belt 1.

The recording material P on which the toner images are transferred is fed toward a fixing device 70 as a fixing means. The fixing device 70 heats and presses the recording material P carrying thereon unfixed toner images, and thus fixes (melts) the toner images on the recording material P. The recording material P on which the toner images are fixed is discharged (outputted) to an outside of an apparatus main assembly of the image forming apparatus 100 by a discharging roller pair (not shown) or the like.

Further, toner (primary transfer residual toner) remaining on the photosensitive drum 101 without being transferred onto the intermediary transfer belt 1 during the primary transfer step is removed and collected from the photosensitive drum 101 by a drum cleaning device 106 as a photosensitive member cleaning means. Further, on the outer peripheral surface side of the intermediary transfer belt 1, at a position opposing the driving roller 11, a belt cleaning device 16 as an intermediary transfer member cleaning means is provided. Toner (secondary transfer residual toner) remaining on the intermediary transfer belt 1 without being transferred onto the recording material P during the secondary transfer step, and paper powder are removed and collected from the surface of the intermediary transfer belt 1 by the belt cleaning device 16.

Here, as the intermediary transfer belt 1, a belt in which an antistatic agent such as carbon black is contained in an appropriate amount in a resin material, such as polyimide or polyamide, or an alloy thereof, or various rubbers is used. In this embodiment, the intermediary transfer belt 1 is formed so that volume resistivity thereof is $1\times10^{9}$-$5\times10^{13}$ Ω/sq. Further, in this embodiment, the intermediary transfer belt 1 is formed in the form of a film-like endless belt of, for example, about 0.04-0.5 mm in thickness.

In this embodiment, as described above, the intermediary transfer belt 1 is extended around and stretched by the driving roller 11, the tension roller 12, the idler rollers 13 and 14, and the inner secondary transfer roller 15.

The driving roller 11 is driven by a motor excellent in constant-speed property, and circulates and moves (rotates) the intermediary transfer belt 1. The tension roller 12 imparts certain tension 12 to the intermediary transfer belt 1. The tension roller 12 is urged from the inner peripheral surface side toward the outer peripheral surface side of the intermediary transfer belt 1 at both end portions thereof with respect to a rotational axis direction thereof by a spring (not shown) which is an elastic member as an urging means. The first and second idler rollers 13 and 14 support the intermediary transfer belt 1 extending along an arrangement direction of the photosensitive drums 101Y, 101M, 101C and 101K. The inner secondary transfer roller 15 functions as an opposing member (opposite electrode) to the outer secondary transfer roller 2. Incidentally, the image forming apparatus 100 is constituted so that tension of the intermediary transfer belt 1 relative to the tension roller 12 is about 3-12 kgf.

Incidentally, as the intermediary transfer belt 1, a belt constituted by a resin-based material formed in a single layer structure or a multi-layer structure can be used. Further, as the intermediary transfer belt 1, a belt of 40 μm or more in thickness, 1.0 GPa or more in Young's modulus, $1.0\times10^{9}$-$1.0\times10^{13}$ Ω/sq. in surface resistivity may preferably be used.

Further, in this embodiment, the primary transfer roller 105 is constituted by a metal roller made of a metal material such as SUM or SUS. Incidentally, in this embodiment, the primary transfer roller 105 has a straight shape with respect to a thrust direction (i.e., has the substantially same outer diameter substantially in an entire region with respect to a rotational axis direction thereof). Further, in this embodiment, an outer diameter of the primary transfer roller 105 is about 6-10 mm.

Further, in this embodiment, the inner secondary transfer roller 15 is constituted by providing an elastic layer (rubber layer) formed with EPDM rubber on an outer peripheral surface of a core metal (base material) made of metal. In this embodiment, the inner secondary transfer roller 15 is formed so that an outer diameter thereof is 20 mm and a thickness of the elastic layer is 0.5 mm. Further, a hardness of the elastic layer of the inner secondary transfer roller 2 is set at, for example, about 70° (Asker-C).

Further, in this embodiment, the outer secondary transfer roller 2 is constituted by providing an elastic layer (rubber layer) formed with metal complex, NBR rubber containing an electroconductive agent such as carbon black or EPDM rubber on an outer peripheral surface of a core metal (base material) made of metal. In this embodiment, the outer secondary transfer roller 2 is formed so that an outer diameter of the core metal is 14 mm and a thickness of the elastic layer is 1 mm and so that an outer diameter thereof is 16 mm.

Incidentally, the image forming apparatus 100 carries out image formation by rotationally driving the intermediary transfer belt 1 so that a peripheral speed of the intermediary transfer belt 1 is 400 mm/sec irrespective of a kind of the recording material P.

2. Constitution of Secondary Transfer Portion

Part (a) of FIG. 2 is a schematic sectional view for illustrating a constitution of the secondary transfer portion T2 in this embodiment (in a cross section substantially perpendicular to the rotational axis direction of the inner secondary transfer roller 15). Herein, as regards arrangement of the stretching rollers 11 to 15 for the intermediary transfer belt 1, the outer secondary transfer roller 2 and a back-up roller 3 described later, "upstream" and "downstream" mean upstream and downstream with respect to the feeding direction of the recording material P unless otherwise specified. Further, as regards the recording material P, "leading end" and "trailing end" mean leading end and trailing end with respect to the feeding direction of the recording material P unless otherwise specified. In this embodiment, rotational axis directions of the stretching rollers 11 to 15 for the intermediary transfer belt 1, the outer secondary transfer roller 2 and the back-up roller 3 described are substantially parallel to each other.

In this embodiment, to a core metal of the outer secondary transfer roller 2, the secondary transfer voltage source 22 is connected. As specifically described later, in this embodiment, the secondary transfer voltage source 22 is a high voltage source capable of switching between a constant voltage and a constant current. Further, in this embodiment, a core metal of the inner secondary transfer roller 15 is electrically grounded (connected to ground potential). In this embodiment, by the inner secondary transfer roller 15 and the outer secondary transfer roller 2, an electric field for transferring the toner images from the intermediary transfer belt 1 onto the recording material P at the secondary transfer portion T2 is created. In this embodiment, to the outer secondary transfer roller 2, the secondary transfer bias of the opposite polarity to the normal charge polarity of the toner is applied, and the inner secondary transfer roller 15 is electrically grounded. As another method, to the inner secondary transfer roller 15, the secondary transfer bias of the same polarity as the normal charge polarity of the toner may be applied, and the outer secondary transfer roller may be electrically grounded. Further, on a side upstream of the inner secondary transfer roller 15, the back-up roller 3 constituted by a roller-type member as a supporting member for supporting the intermediary transfer belt 1 is in contact with the inner peripheral surface of the intermediary transfer belt 1. Further, the image forming apparatus 100 is provided with a moving mechanism 4 as a moving means for making a penetration amount of the back-up roller 3 into the intermediary transfer belt 1 variable. Specifically, as described above, in this embodiment, the penetration amount of the back-up roller 3 into the intermediary transfer belt 1 can be set at two levels of 0 mm and 2 mm. The penetration amount will be further described later, but in broad outline, is a penetration amount of the back-up roller 3 into a surface (stretching surface) of the intermediary transfer belt 1 formed in the case where the intermediary transfer belt 1 is stretched by the inner secondary transfer roller 15 and the second idler roller 14.

FIG. 3 is a schematic sectional view (cross-section substantially perpendicular to the rotational axis direction of the inner secondary transfer roller 15) in the neighborhood of the secondary transfer nip T2 in this embodiment. In this embodiment, the outer secondary transfer roller 2 is shifted (offset) and disposed toward a side upstream of the inner secondary transfer roller 15. In this embodiment, the outer secondary transfer roller 2 is contacted to the intermediary transfer belt 1 toward the inner secondary transfer roller 15. By this constitution, in this embodiment, a width of the secondary transfer nip T2 which is a contact region between the outer secondary transfer roller 2 and the intermediary transfer belt 1 is made broader toward the upstream side than a width of a contact region between the inner secondary transfer roller 15 and the intermediary transfer belt 1. That is, an upstream-side end portion of the contact region between the outer secondary transfer roller 2 and the intermediary transfer belt 1 is positioned on a side upstream of an upstream-side end portion of the contact region between the inner secondary transfer roller 15 and the intermediary transfer belt 1. By disposing the outer secondary transfer roller 2 so as to be shifted toward the side upstream relative to the inner secondary transfer roller 15, an intimate contact property between the recording material P and the intermediary transfer belt 1 on a side upstream of the secondary transfer nip T2 is improved, so that a transfer property can be improved.

The back-up roller 3 is disposed so as to be contactable to the inner peripheral surface of the intermediary transfer belt 1 on a side upstream of the inner secondary transfer roller 15 and downstream of the second idler roller 14. The back-up roller 3 is disposed adjacent to the inner secondary transfer roller 15 on the side upstream of the inner secondary transfer roller 15 and is disposed adjacent to the second idler roller 14 on the side downstream of the second idler roller 14. Typically, the back-up roller 3 is disposed so as to be contactable to the inner peripheral surface of the intermediary transfer belt 1 in a range from the contact region between the intermediary transfer belt 1 and the inner secondary transfer roller 15 to a position of 25 mm or less toward the upstream side. Further, the back-up roller 3 presses the intermediary transfer belt 1 from the inner peripheral surface side toward the outer peripheral surface side by being moved by the moving mechanism 4, so that the intermediary transfer belt 1 can be projected toward the outer peripheral surface side. In other words, the back-up roller 3 is capable of changing the width of the secondary transfer nip (the contact region between the outer secondary transfer roller 2 and the intermediary transfer belt 1) T2 by being moved by the moving mechanism 4. With an increasing penetration amount (an amount in which the intermediary transfer belt 1 is projected toward the outer peripheral surface side) of the back-up roller 3 into the intermediary transfer belt 1, the width of tehe secondary transfer nip T2 is increased. By such a constitution, particularly, when the intermediary transfer belt 1 is projected toward an outside by the back-up roller 3, an effect of suppressing the "transfer void" by suppressing waving and vibration of the intermediary transfer belt 1 can be obtained. Setting of the penetration amount of the back-up roller 3 relative to the intermediary transfer belt 1 will be further described later.

In this embodiment, the back-up roller 3 is rotatably supported by bearing members 31 (part (b) of FIG. 2) at opposite end portions thereof with respect to the rotational axis direction. In this embodiment, the back-up roller 3 is a roller (metal roller) made of SUS. A length of the back-up roller 3 with respect to the rotational axis direction is equal to a length (width) of the intermediary transfer belt 1 with respect to a direction substantially perpendicular to the rotational direction of the intermediary transfer belt 1, so that the back-up roller 3 contacts the intermediary transfer belt 1 over substantially full width thereof. The back-up roller 3 is rotated with rotation of the intermediary transfer belt 1 in a contact state with the intermediary transfer belt 1. In this embodiment, an outer diameter of the back-up roller is 8 mm.

Incidentally, in this embodiment, the back-up roller 3 is formed of SUS which is an electroconductive material as described above. This back-up roller 3 may preferably be electrically grounded (connected to ground potential (grounding)) via a resistor such as a varistor. By electrically grounding the back-up roller 3 via the resistor, by suppressing a flow of a current into the back-up roller 3 when the secondary transfer bias is applied to the outer secondary transfer roller 2, deficiency of the transfer current can be suppressed. In the case where the varistor is used as the resistor, for example, when an applied voltage to the outer secondary transfer roller 2 is 0.5-8 kV and a surface resistivity of the intermediary transfer belt 1 is $1.0\times10^{9}$-$1.0\times10^{13}$ Ω/sq., a varistor having a varistor voltage of 1.0 kV or more may preferably be used. In this embodiment, the back-up roller 3 was electrically grounded via a varistor 33 (part (a) of FIG. 2) of 1.5 kV in varistor voltage.

In FIG. 3, a common tangential line of the inner secondary transfer roller 15 and the second idler roller 14 on a side where the intermediary transfer belt 1 is extended around the stretching rollers is a reference line L. Further, a tangential line of the intermediary transfer belt 1 which is substantially parallel to the reference line L and which is in the contact region of the back-up roller 3 with the intermediary transfer belt 1 is a supporting portion tangential line Ld. At this time, a distance X between the reference line L and the supporting portion tangential line Ld is a penetration amount of the back-up roller 3 into the intermediary transfer belt 1 (in this case, the penetration amount is a positive value when the supporting portion tangential line Ld is further on an outside of the intermediary transfer belt 1 than the reference line L is). The penetration amount X is predetermined so that the intimate contact property between the recording material P and the intermediary transfer belt 1 is not impaired by an unstable attitude of the intermediary transfer belt 1 due to vibration and waving of the intermediary transfer belt 1 in the neighborhood of the secondary transfer nip T2 as specifically described later.

Incidentally, in FIG. 3, a rectilinear line which passes through a rotation center of the inner secondary transfer roller 15 and which is substantially perpendicular to the reference line L is referred to as an inner roller center line La. Further, a rectilinear line which passes through a rotation center of the outer secondary transfer roller 2 and which is substantially perpendicular to the reference line L is referred to as an outer roller center line Lb. At this time, a distance between the inner roller center line La and the outer roller center line Lb is a shift amount L1 of the outer secondary transfer roller 2 relative to the inner secondary transfer roller 15 (in this case, the shift amount L1 is a positive value when the outer roller center line Lb is on the side upstream of the inner roller center line La). In this embodiment, this shift amount L1 satisfies a relationship of L1>0.

Part (b) of FIG. 2 is a schematic side view of one end portion side of the back-up roller 3 with respect to the rotational axis direction as seen in the rotational axis direction of the back-up roller 3. The moving mechanism 4 includes an eccentric cam 41 as an operation member and a tension spring 42 which is an elastic member as an urging member at each of opposite end portions of the back-up roller 3 with respect to the rotational axis direction. Further, the moving mechanism 4 includes a driving portion 43 for driving the eccentric cam 41 at each of the opposite end portions of the back-up roller 3 with respect to the rotational axis direction. The bearing members 31 for the back-up roller 3 are held by a casing or the like of a unit including the apparatus main assembly and the intermediary transfer belt 1 of the image forming apparatus 100 so as to be movable in a direction crossing (in this embodiment, perpendicular to) the above-described reference line L. The tension spring 42 urges the bearing member 31 in a direction in which the intermediary transfer belt 1 is moved from the outer peripheral surface side toward the inner peripheral surface side. Further, as shown in a left-hand view of part (b) of FIG. 2, urging of the bearing member 31 by the eccentric cam 41 is eliminated by rotating the eccentric cam 41 by the driving portion 43. As a result, the bearing member 31 is moved by the tension spring 42 in the direction from the outer peripheral surface side toward the inner peripheral surface side of the intermediary transfer belt 1 along the direction substantially perpendicular to the above-described reference line L, so that the back-up roller 3 is disposed at a first position. Further, as shown in a right-hand view of part (b) of FIG. 2, the bearing member 31 is urged by the eccentric cam 41 against an urging force of the tension spring 42 by rotating the eccentric cam 41 by the driving portion 43. As a result, the bearing member 31 is moved in the direction from the inner peripheral surface side toward the outer peripheral surface side of the intermediary transfer belt 1 along the direction substantially perpendicular to the above-described reference line L, so that the back-up roller 3 is disposed at a second position. The first position is a position further on the inner peripheral surface side of the intermediary transfer belt 1 than the second position is, and when the back-up roller 3 is in the first position, the penetration amount X is X1. Further, the second position is a position further on the outer peripheral surface side of the intermediary transfer belt 1 than the first position is, and when the back-up roller 3 is in the second position, the penetration amount X is X2 (>X1).

In this embodiment, the penetration amount X1 is 0 mm, and the penetration amount X2 is 2 mm. Incidentally, the penetration amount X may also be a negative value, and in the case where the penetration amount X is the negative value, the back-up roller 3 is separated from the inner peripheral surface of the intermediary transfer belt 1. However, even in the case where the penetration amount X is made small, from the viewpoint of suppressing the wearing and vibration of the intermediary transfer belt 1, the penetration amount X may preferably be 0 mm or more (i.e., 0 mm≤X1<X2). For example, the penetration amount may also be 0 mm<X1.

3. Control Mode

FIG. 4 is a schematic block diagram showing a control mode of a principal part of the image forming apparatus 100 in this embodiment. A controller (DC controller) 50 is constituted by including a CPU 51 as a control means which is a dominant element for performing processing, and memories (storing media) 52 such as a ROM and a RAM which are used as storing means. In the RAM which is rewritable memory, information inputted to the controller 50, detected information, a calculation result and the like are stored. In the ROM, a data table acquired in advance and the like are stored. The CPU 51 and the memories 52 are capable of transferring and reading the data therebetween.

To the controller 50, a secondary transfer voltage source 22 is connected through a D/A converter 21. Further, to the secondary transfer voltage source 22, a voltage/current detecting portion 23 as a detecting means is connected, and this voltage/current detecting portion 23 is connected to the controller 50 through an A/D converter 24. The voltage/current detecting portion 23 is capable of detecting a current flowing through the outer secondary transfer roller 2 when a bias is applied to the outer secondary transfer roller 2 by the secondary transfer voltage source 22. Further, the controller 50 is capable of constant-current controlling the belt applied from the secondary transfer voltage source 22 to the outer secondary transfer roller 2 by controlling a voltage outputted from the secondary transfer voltage source 22 so that a value of the current detected by the voltage/current detecting portion 23 is a predetermined current value. Further, the voltage/current detecting portion 23 is capable of detecting a value of a voltage outputted when the bias is applied from the secondary transfer voltage source 22 to the outer secondary transfer roller 2. Further, the controller 50 is capable of constant-voltage controlling the bias applied form the secondary transfer voltage source 22 to the outer secondary transfer roller 2 by controlling the voltage outputted from the secondary transfer voltage source 22 so that a value of the voltage detected by the voltage/current detecting portion 23 is a predetermined voltage value.

Further, to the controller 50, the moving mechanism 4 is connected. The controller 50 controls drive of the moving mechanism 4 and is capable of selectively disposing the back-up roller 3 at the above-described first position and second position.

Further, to the controller 50, an operating portion (operating panel) 90 is connected. The operating portion 90 displays a selection screen of the recording material P and is capable of causing an operator such as a user or a service person to select a kind of the recording material used for image formation, an imaging mode (for example, whether or not a paper kind mixing job should be carried out) and the like. Further, to the image forming apparatus 100, information on a job is inputted from an external host device (not shown), such as a personal computer, communicatably connected to the image forming apparatus 100. The information on the job includes not only image data (image information signal), but also data for designating the kind of the recording material P used for the image formation, data for designating the image forming job (for example, whether or not the paper kind mixing job should be carried out) and the like. Incidentally, the kind of the recording material P includes attributes based on general features such as plain paper, thick paper, thin paper, glossy paper, coated paper and embossed paper and includes arbitrary information capable of discriminating the recording material P, such as a manufacturer, a brand, a product number, a basis weight, a thickness and a size. In this embodiment, as a settable kind of the recording material P, at least plain paper, paper relatively low in smoothness set in advance, and paper relatively high in rigidity such as thick paper can be selected.

The controller 50 carries out integrated control of respective positions, so that a sequence control is carried out. Into the controller 50 image data is inputted from an image reading device (not shown) or the external host device (not shown). Further, into the controller 50, a control instruction containing information on the kind of the recording material P used for the image formation and on the image forming mode is inputted from the operating portion 90 or the external host device (not shown). Then, the controller 50 controls the respective portions in accordance with these pieces of information, so that the image formation is carried out.

Here, the image forming apparatus 100 executes a job (printing operation) which is a series of operations which is started by a single start instruction (print instruction) and in which the image is formed and outputted on a single recording material P or a plurality of recording materials P. The job includes an image forming step, a pre-rotation step, a sheet (paper) interval step in the case where the images are formed on the plurality of recording materials P, and a post-rotation step in general. The image forming step is performed in a period in which formation of an electrostatic image for the image actually formed and outputted on the recording material P, formation of the toner image primary transfer of the toner image and secondary transfer of the toner image are carried out, in general. Specifically, timing during the image formation is different among positions where the respective steps of the formation of the electrostatic image, the toner image formation, the primary transfer of the toner image and the secondary transfer of the toner image are performed. The pre-rotation step is performed in a period in which a preparatory operation, before the image forming step, from an input of the start instruction until the image is started to be actually formed, is carried out. The sheet interval step is performed in a period corresponding to an interval between a recording material P and a subsequent recording material P when the images are continuously formed on a plurality of recording materials P (continuous image formation). The post-rotation step is performed in a period in which a post-operation (preparatory operation) after the image forming step is performed. During non-image formation (non-image formation period) is a period other than the period of the image formation and includes the periods of the pre-rotation step, the sheet interval step, the post-rotation step and further includes a period of a pre-multi-rotation step which is a preparatory operation during turning-on of a main switch (voltage source) of the image forming apparatus 100 or during restoration from a sleep state. In this embodiment, during the non-image formation, control (adjustment) of the secondary transfer bias is carried out.

In this embodiment, the secondary transfer bias is controlled by ATVC (active transfer voltage control) which is a set voltage determining operation. That is, at predetermined timing when the recording material P does not exist in the secondary transfer nip T2, a bias which has been subjected to constant-current control is applied to the outer secondary transfer roller 2 while adjusting an output voltage value of the secondary transfer voltage source 22 so that the current flowing through the outer secondary transfer roller 2 approaches a target current value Itgt. Further, sampling of the output voltage value of the secondary transfer voltage source 22 at that time is carried out. This operation is performed for a predetermined period (or the number of times of occurrences), whereby an average of the output voltage values subjected to the sampling is acquired. Then, the thus acquired voltage value or a voltage value obtained by subjecting this voltage value to a predetermined processing is determined as a secondary transfer portion sharing voltage Vt. Then, during the image formation (during the secondary transfer), a secondary transfer bias subjected to constant voltage control with a voltage value obtained by adding a recording material sharing voltage Vp to the secondary transfer portion sharing voltage Vt is applied to the outer secondary transfer roller 2. That is, an instruction is provided from the controller 50 and is converted into an analog value by the D/A converter 310, and thereafter, a high voltage is outputted from the secondary transfer voltage source 22 and a voltage value at that time is detected by the voltage current detecting portion 23, and then the detected voltage value is subjected to digital conversion by the A/D converter 24 and is fed back to the controller 50. Then, during the image formation (during the secondary transfer), a secondary transfer bias subjected to the constant voltage control at a voltage value obtained by adding the recording material sharing voltage Vp to the voltage value (the secondary transfer portion sharing voltage) Vt acquired by this control is applied to the outer secondary transfer roller 2. The target current value Itgt is set in advance depending on, for example, an environment, and then is stored in the memory 52 as table data or the like. Further, the recording material sharing voltage Vp is set in advance depending on the kind of the recording material P, the environment or the like, and then is stored in the memory 52 as table data or the like.

Incidentally, in this embodiment, as described above, in order to adjust the secondary transfer bias, the voltage value when a test bias subjected to the constant-control at a predetermined current value is applied is detected. As another method, in order to adjust the secondary transfer bias, a current value when a test bias subjected to the constant-voltage control at a predetermined voltage value is applied may also be detected. It may only be required that information on an electric resistance of the transfer portion is acquired.

4. Penetration Amount

FIG. 5 is a graph showing a result of investigating a relationship between the penetration amount X of the back-up roller 3 and a distance from a leading end of the recording material P to a position of an occurrence of the above-described "white void" with respect to the feeding direction of the recording material P (herein, this distance is referred to as a "white void distance"). Incidentally, the "white void distance" is represented by a distance from the leading end of the recording material P to the white void occurred on a most trailing end side. As the recording material P, "I-BEST w, basis weight: 360 gsm" which is an example of thick paper having a relatively large basis weight and having a relatively high rigidity was used. FIG. 5 shows a result of the case where there is no back-up roller 3 (corresponding to the case where the penetration amount X is a negative value), the case where the penetration amount X is 0 mm, and the case where the penetration amount X is 2 mm.

From FIG. 5, it is understood that the white void distance increases in the order of the case where there is no back-up roller 3, the case where the penetration amount X is 0 mm, and the case where the penetration amount X is 2 mm. In this embodiment, a target value of a margin at a leading end portion of the recording material P is 3 mm or less, and therefore, in this embodiment, in the case of the thick paper, the penetration amount X of the back-up roller 3 was set at 0 mm.

Incidentally, in this embodiment, a result of investigation on the "white void" at the leading end portion of the recording material P was described as an example, but in the case of the above-described set value, it was confirmed that also another image defect (such as "scattering" or the like described above) in the neighborhood of the leading end of the recording material P falls within a target value. Further, the case where a target value of a margin at a trailing end portion of the recording material P is 3 mm or less was investigated, but in the case of the above-described set value, it was confirmed that also image defects such as the "white void", the "scattering" and the like in the neighborhood of the trailing end of the recording material P fall within target values.

FIG. 6 is a graph showing a relationship between the penetration amount X of the back-up roller 3 and a rank of the "transfer void". The rank of the "transfer void" is an evaluation index ranking a degree of a void of a secondary color (in this embodiment, a sum of a magenta image ratio of 100% and a cyan image ratio of 100%) at a recessed portion of the recording material P having relatively low smoothness on a scale of 0 to 9 (10 scales in which rank 9 is best). As the recording material P, "Hammermill Great White 30% Recycled Paper, basis weight: 75 gsm" was used. FIG. 6 shows a result of the cases where the penetration amount X is 0 mm, 1 mm and 2 mm.

From FIG. 6, it is understood that the rank of the "transfer void" increases in the order of the case where the penetration amount X of the back-up roller 3 is 0 mm, the case where the penetration amount X of the back-up roller 3 is 1 mm, and the case where the penetration amount X of the back-up roller 3 is 2 mm. In this embodiment, a target value of the "transfer void" is 8 or more, and therefore, in the case of the paper having the low smoothness, the penetration amount X of the back-up roller 3 was set at 2 mm.

Incidentally, in this embodiment, a result of investigation on the "transfer void" of the secondary color was described as an example, but in the case of the above-described set value, it was confirmed that also other image defects such as the waving and the vibration of the intermediary transfer belt 1 fall within target values.

Further, although the penetration amounts X are not limited to the values described above, typically, the penetration amount X is about 3.5 mm or less. In the case where the penetration amount X is larger than 3.5 mm, a load exerted on a contact surface the back-up roller 3 and the intermediary transfer belt 1 increases, so that there is a possibility that the intermediary transfer belt 1 does not readily rotate smoothly.

5. Penetration Amount and Secondary Transfer Bias

FIG. 7 is a graph showing voltage-current characteristics of the secondary transfer portion T2 in this embodiment. In FIG. 7, a solid line represents the voltage-current characteristic of the case where the penetration amount X of the back-up roller 3 is 2 mm, and a broken line represents the voltage-current characteristic of the case where the penetration amount X of the back-up roller 3 is 0 mm.

From FIG. 7, it is understood that the voltage-current characteristic changes depending on the penetration amount X of the back-up roller 3 and that a value of a voltage to be applied for causing a current having a certain target value Itgt to flow through the secondary transfer portion T2 changes depending on the penetration amount X of the back-up roller 3. That is, the secondary transfer portion sharing voltage Vt acquired by the ATVC is V2 in the case where the penetration amount X is 0 mm and is V2 ($|V1|>|V2|$) in the case where the penetration amount X is 2 mm.

For that reason, in the case where the penetration amount X of the back-up roller 3 is changed, when the same setting of the secondary transfer bias is made, excess and deficiency of the secondary transfer bias occur, so that the toner images cannot be transferred from the intermediary transfer belt 1 onto the recording material P in some instances.

Therefore, in this embodiment, the setting of the secondary transfer bias is changed depending on the penetration amount X of the back-up roller 3.

6. Control Flow

FIG. 8 is a flowchart showing an outline of a control procedure of a job in this embodiment. When a start instruction of the job is inputted, the controller 50 discriminates whether or not the job is a "paper kind mixing job" (S101). The "paper kind mixing job" refers to a job in which images are formed on a plurality of kinds of recording materials. The controller 50 is capable of discriminating whether or not the job is the paper kind mixing job, on the basis of a control instruction inputted from the operating portion 90 or the external host device (not shown). In the case where the controller 50 discriminated that the job is the paper kind mixing job in S101, the controller 50 discriminates whether or not the job is "position movement job" (S102). The "position movement job" refers to a job (paper kind mixing job) in which images are formed on a plurality of kinds of recording materials P for which a position (penetration amount) of the back-up roller 3 should be changed. Particularly, in this embodiment, the "paper kind mixing job" in which the images are formed on thick paper having a relatively large basis weight and having a relatively high rigidity and on paper having relatively low smoothness is the "position movement job".

In the case where the controller 50 discriminated that the job is the "position movement job" in S102, in the pre-rotation step, the controller 50 carries out the ATVC (set voltage determining operation) in each of states different in penetration amount X of the back-up roller 3 (S103, S104). In this embodiment, the ATVC is carried out in each of a state (first state) in which the penetration amount X of the back-up roller 3 is X1 (0 mm) and a state (second state) in which the penetration amount X of the back-up roller 3 is X2 (2 mm). That is, the controller 50 first determines a secondary transfer portion sharing voltage V1 in the state of the penetration amount X1 (0 mm) by the ATVC and stores the secondary transfer portion sharing voltage V1 in the memory 52 (S103). Then, the controller 50 discriminates whether or not the change of the position of the back-up roller 3 is ended (S104). In the case where the controller 50 discriminated that the change of the position of the back-up roller 3 is not ended, the controller 50 causes the moving mode 4 to move the back-up roller 3. Then, the controller 50 determines a secondary transfer portion sharing voltage V2 in the state of the penetration amount X2 (2 mm) by the ATVC and stores the secondary transfer portion sharing voltage V2 in the memory 52 (S103).

In the case where the controller 50 discriminated that the change of the position of the back-up roller 3 is ended in S104, the controller 50 starts an image forming step upon an end of another operation in the pre-rotation step (S105). In the image forming step of the "position movement job", when the image is formed on the thick paper, not only the penetration amount X is set at X1 (0 mm) but also a secondary transfer bias subjected to constant-voltage control at a voltage value obtained by adding the recording material sharing voltage Vp to the secondary transfer portion sharing voltage V1 is applied to the outer secondary transfer roller 2. Further, when the image is formed on the paper having the relatively low smoothness, not only the penetration amount X is set at X2 (2 mm) but also a secondary transfer bias subjected to constant-voltage control at a voltage value obtained by adding the recording material sharing voltage Vp to the secondary transfer portion sharing voltage V2 is applied to the outer secondary transfer roller 2.

Further, in the case where the controller 50 discriminated that the job is not the "paper kind mixing job" in S101 and in the case where the controller 50 discriminated that the job is not the "position movement job" in S102, the controller 50 carried out the ATVC in a state of the penetration amount X corresponding to the kind of the recording material P designated in the job (S106). For example, when the recording material P designated in the job is the thick paper, the controller 50 determines the secondary transfer portion sharing voltage V1 by the ATVC in a state in which the penetration amount X is X1 (0 mm). Further, when the recording material P designated in the job is the paper having the relatively low smoothness, the controller 50 determines the secondary transfer portion sharing voltage V2 by the ATVC in a state in which the penetration amount X is X2 (2 mm). Then, in the image forming step, the penetration amount X of the back-up roller 3 is set at a penetration amount X corresponding to the kind of the recording material P designated in the job. In addition, a secondary transfer bias subjected to constant-voltage control at a voltage value obtained by adding the recording material sharing voltage Vp to a secondary transfer portion sharing voltage Vt corresponding to the penetration amount X is applied to the outer secondary transfer roller 2.

Further, when formation of all the images in the job is ended in S105, the job is ended.

FIG. 9 shows an example of a voltage/current waveform of the secondary transfer portion T2 in the case where the "position movement job" is executed in this embodiment. In this embodiment, a first sheet was the "I-BEST, basis weight: 360 gsm" which is the example of the thick paper having the relatively large basis weight and having the relatively high rigidity, and a second sheet and later sheets were the "Hammermill Great White 30% Recycled Copy Paper, basis weight: 75 gsm" which is the example of the paper having the relatively low smoothness.

In the pre-rotation step, first, the position of the back-up roller 3 is set at a first position (penetration amount X1), and the secondary transfer portion sharing voltage V1 is determined by the ATVC. Thereafter, the position of the back-up roller 3 is changed to a second position (penetration amount X2), and the secondary transfer portion sharing voltage V2 is determined by the ATVC. Thereafter, before the first thick paper reaches the secondary transfer nip T2, the position of the back-up roller 3 is changed to the first position (penetration amount X1). Then, the secondary transfer bias subjected to the constant-voltage control at the voltage value obtained by adding the recording material sharing voltage Vp to the secondary transfer portion sharing voltage V1 is applied to the outer secondary transfer roller 2 during the secondary transfer of the image on the first sheet. Thereafter, in a sheet interval between the first sheet and the second sheet (i.e., before the second paper having the relatively low smoothness reaches the secondary transfer nip T2), the position of the back-up roller 3 is changed to the second position (penetration amount X2). Then, the secondary transfer bias subjected to the constant-voltage control at the voltage value obtained by adding the recording material sharing voltage Vp to the secondary transfer portion sharing voltage V2 is applied to the outer secondary transfer roller 2 during the secondary transfer of the image on the second sheet (ditto for a third sheet and later sheets). Thus, not only the position (penetration amount) of the back-up roller 3 is optimized depending on the kind of the recording material P, but also setting of the secondary transfer bias is optimized depending on the position (penetration amount) of the back-up roller 3.

An optimum value of the setting of the secondary transfer bias is determined from the viewpoints of a density, an image quality and the like in advance. In this embodiment, as an example, Itgt was 60 μA, Vp was 750 V, V1 was 2500 V, and V2 was 2250 V.

Incidentally, FIG. 10 shows an example of a voltage/current waveform of the secondary transfer portion T2 in the case where a job which is not the "position movement job" is executed. FIG. 10 shows a waveform in the case where the position (penetration amount) of the back-up roller 3 corresponding to the recording material P designated in the job is the first position (penetration amount X1=0 mm). In this case, the change of the position (penetration amount) of the back-up roller 3 in the pre-rotation step and the sheet interval step is not made.

Thus, in this embodiment, the image forming apparatus 100 includes a rotatable endless belt 1 for feeding the toner image carried at the image forming position (primary transfer portion) T1. Further, the image forming apparatus 100 includes the outer roller (outer secondary transfer roller) 2, contacting the outer peripheral surface of the belt 1, for forming the transfer portion T2 where the toner image is transferred from the belt 1 onto the recording material P. Further, the image forming apparatus 100 includes the plurality of stretching rollers 11 to 15 for stretching the belt 1. The plurality of stretching rollers 11 to 15 includes the inner roller (inner secondary transfer roller) 15 disposed correspondingly to the transfer portion T2 and the upstream roller (second idler roller) 14 disposed on the side downstream of the image forming portion T1 and upstream of the inner roller 15 with respect to the rotational direction of the belt 1. Further, the image forming apparatus 100 includes the voltage source 22 for applying the transfer bias, for transfer of the toner image, to the outer roller 2 or the inner roller 15. Further, the image forming apparatus 100 includes the supporting member 3 contactable to the inner peripheral surface of the belt 1 on the side voltage of the inner roller 15 and downstream of the upstream roller 14 with respect to the rotational direction of the belt 1. Further, the image forming apparatus 100 includes the moving means (moving mechanism) 4 for moving the supporting member 3 between the first position and the second position different from the first position in the cross-section substantially perpendicular to the rotational axis direction of the inner roller 15. Further, the image forming apparatus 100 includes the detecting means 23 for detecting the current value or the voltage value (in this embodiment, the voltage value) when the bias is applied from the voltage source 22 to the outer roller 2 or the inner roller 15. Further, the image forming apparatus 100 is capable of executing an operation in the first mode in which the image is formed on the recording material P in a state in which the supporting member 3 is disposed at the first position and executing an operation in the second mode in which the image is formed on the recording material P in a state in which the supporting member 3 is disposed at the second position. In addition thereto, during non-image formation, the image forming apparatus 100 is capable of executing an operation in a test mode (ATVC) for adjusting the transfer bias on the basis of a detection result of the detecting means 23 acquired under application of the test bias to the outer roller 2 or the inner roller 15 from the voltage source 22.

Then, in this embodiment, the controller 50 determines the first transfer bias applied from the voltage source 22 to the outer roller 2 or the inner roller 15, on the basis of a first detection result of the detecting means 23 acquired under application of the test bias in the state in which the supporting member 3 is disposed at the first position. Further, in this embodiment, the controller 50 determines the second transfer bias applied from the voltage source 22 to the outer roller 2 or the inner roller 15, on the basis of a second detection result of the detecting means 23 acquired under application of the test bias in the state in which the supporting member 3 is disposed at the second position. In this embodiment, in the case where the penetration amount X is defined as described above, the second penetration amount X2 which is the penetration amount X in the operation in the second mode is larger than the first penetration amount X1 which is the penetration amount X in the operation in the first mode. Further, an absolute value of the second transfer bias is smaller than an absolute value of the first transfer bias. Typically, the penetration amount X is 0 mm or more. In this embodiment, the controller 50 effects control so as to execute the operation in the first mode in the case where the image is transferred onto the first kind of the recording material P and so as to execute the operation in the second mode in the case where the image is transferred onto the second kind of the recording material P. Typically, a basis weight of the first kind of the recording material P is larger than a basis weight of the second kind of the recording material P. Further, in this embodiment, switching of the position of the supporting member 3 between the first position and the second position is made when there is no recording material P in the transfer portion T2. In this embodiment, switching of the mode between the first mode and the second mode is made when there is no recording material P in the transfer portion T2.

Further, in this embodiment, the controller 50 acquires both of the first detection result and the second detection result in the pre-rotation step of the job in which the operations in the first mode and the second mode are executed, and executes the operation in the test mode for determining both of the first transfer bias and the second transfer bias. On the other hand, in this embodiment, the controller 50 acquires only one of the first detection result and the second detection result in the pre-rotation step of the job for executing only one of the operations in the first mode and the second mode, and executes the test mode for determining only one of the first transfer bias and the second transfer bias. In other words, in this embodiment, the controller 50 is capable of selectively executing, as the operation in the test mode, the operation in the first test mode and the operation in the second test mode. The first test mode is a test mode in which the test bias is applied in each of the state in which the supporting member 3 is disposed at the first position and the state in which the supporting member 3 is disposed at the second position. The second test mode is a test mode in which the test bias is applied only in the state in which the supporting member 3 is disposed at one of the first position and the second position. In FIG. 8, processes of S103 and S104 correspond to processes of the first test mode. Further, in FIG. 8, a process of S106 corresponds to a process of the second test mode. Further, in this embodiment, in the case of a position change job, the position of the supporting member 3 was changed to the first position and the second position and the test bias was applied during the pre-rotation step, but the present invention is not limited thereto. For example, a constitution in which the ATVC executed during the pre-rotation step is executed only in one of the state in which the supporting member 3 is disposed at the first position and the state in which the supporting member 3 is disposed at the second position may also be employed. For example, a constitution in which the ATVC is executed in the penetration amount of the supporting member 3 set for the first sheet in the image forming job may also be employed. Thereafter, the image formation on the first sheet is started without changing the position of the back-up roller 3. Then, the ATVC may also be executed after the position of the supporting member 3 is changed at timing of switching the position of the supporting member 3 during the image forming job. That is, in the case of FIG. 9, the position of the back-up roller 3 is set at the first position (penetration amount X1) during the pre-rotation step. Then, the ATVC is executed in this state, and the transfer bias is set. Thereafter, the image is formed on the first sheet. Then, the position of the back-up roller 3 is changed to the second position (penetration amount X2) in the sheet interval between the first sheet and the second sheet. Then, in this state, the ATVC is executed and the transfer bias is set. Thereafter, the images is formed on the second sheet. Thus, when the ATVC is executed at timing of switching the supporting member 3, an optimum transfer bias can be set immediately before the image formation.

As described above, according to this embodiment, the improper transfer due to the excess and deficiency of the transfer bias can be suppressed while compatibly realizing improvement in transfer property onto the recording material having the low smoothness and suppression of the image defect in the neighborhood of the leading and trailing end portions of the recording material having the relatively high rigidity. That is, according to this embodiment, even in the constitution in which the position of the supporting member is changeable, it becomes possible to suppress the improper transfer due to the excess and deficiency of the transfer bias.

Embodiment 2

Next, another embodiment of the present invention will be described. Basic constitutions and operations of an image forming apparatus in this embodiment are the same as those of the image forming apparatus in Embodiment 1. Accordingly, elements having the same or corresponding functions or constitutions are represented by the same reference numerals or symbols and will be omitted from detailed description.

In Embodiment 1, the ATVC executed in each of the plurality of different penetration amounts X of the back-up roller 3, and the secondary transfer biases corresponding to the respective penetration amounts X were determined. On the other hand, in this embodiment, the ATVC is executed with respect to at least one of the plurality of different penetration amounts X of the back-up roller 3, and the secondary transfer bias corresponding to the penetration amount X is determined. Then, on the basis of a result of the ATVC, the secondary transfer bias corresponding to at least one (another) penetration amount X is determined.

FIG. 11 shows an example of a voltage/current waveform of the secondary transfer portion T2 in the case where the "position movement job" is executed in this embodiment. In this embodiment, a first sheet was the "I-BEST, basis weight: 360 gsm" which is the example of the thick paper having the relatively large basis weight and having the relatively high rigidity, and a second sheet and later sheets were the "Hammermill Great White 30% Recycled Copy Paper, basis weight: 75 gsm" which is the example of the paper having the relatively low smoothness.

In the pre-rotation step, the position of the back-up roller 3 is set at a first position (penetration amount X1=0 mm), and the secondary transfer portion sharing voltage V1 is determined by the ATVC. Thereafter, the position of the back-up roller 3 is not changed, and the secondary transfer bias subjected to the constant-voltage control at the voltage value obtained by adding the recording material sharing voltage Vp to the secondary transfer portion sharing voltage V1 is applied to the outer secondary transfer roller 2 during the secondary transfer of the image on the first sheet. Thereafter, in a sheet interval between the first sheet and the second sheet (i.e., before the second paper having the relatively low smoothness reaches the secondary transfer nip T2), the position (penetration amount) of the back-up roller 3 is changed to the second position (penetration amount X2=2 mm). Then, the secondary transfer bias subjected to the constant-voltage control at the voltage value obtained by adding the recording material sharing voltage Vp to the secondary transfer portion sharing voltage V2 acquired by multiplying the above-described secondary transfer portion sharing voltage V1 by a predetermined coefficient C is applied to the outer secondary transfer roller 2 during the secondary transfer of the image on the second sheet (ditto for a third sheet and later sheets). Thus, not only the position (penetration amount) of the back-up roller 3 is optimized depending on the kind of the recording material P, but also setting of the secondary transfer bias is optimized depending on the position (penetration amount) of the back-up roller 3.

An optimum value of the setting of the secondary transfer bias is determined from the viewpoints of a density, an image quality and the like in advance. In this embodiment, as an example, Itgt was 60 μA, Vp was 750 V and V1 was 2500 V. Further, in this embodiment, V2 is derived from V2=C×V1 using the coefficient C=0.9 set in advance from an experiment on a change of V2 relative to V1 due to the change of the position (penetration amount) of the back-up roller 3. In the case where V1 is 2500 V, V2 is 2250 V. The coefficient C is stored in the memory 52 in advance. The coefficient C is appropriately changeable depending on a constitution of the image forming apparatus 100.

Thus, in this embodiment, the controller 50 determines the first transfer bias applied from the voltage source 22 to the outer roller 2 or the inner roller 15, on the basis of a detection result of the detecting means 23 acquired under application of the test bias in the state in which the supporting member 3 is disposed at the first position. Further, in this embodiment, the controller 50 determines the second transfer bias applied from the voltage source 22 to the outer roller 2 or the inner roller 15, on the basis of the detection result and the predetermined coefficient set in advance.

In this embodiment, the controller 50 acquires the detection result of the detecting means 23 in the pre-rotation step of the job in which the operations in the first mode and the second mode are executed, and executes the operation in the test mode for determining both of the first transfer bias and the second transfer bias.

In this embodiment, the second transfer bias was determined by multiplying the first transfer bias by the predetermined coefficient set in advance, but a predetermined constant may also be added. Further, the second transfer bias different from the first transfer bias may also be determined on the basis of a detection result of the detecting means 23 acquired under application of a test bias in a state in which the supporting member 3 is disposed at the first position and on the basis of a predetermined relationship.

As described above, according to this embodiment, not only an effect similar to the effect of Embodiment 1, but also shortening of a time of the pre-rotation step and simplification of control can be realized.

Embodiment 3

Next, another embodiment of the present invention will be described. Basic constitutions and operations of the image forming apparatus in this embodiment are the same as those of the image forming apparatus in Embodiment 1. Accordingly, elements having the same or corresponding functions or constitutions are represented by the same reference numerals or symbols and will be omitted from detailed description.

In Embodiment 1, the change of the back-up roller 3 was made when there is no recording material P in the secondary transfer nip T2 before the recording material P reaches the secondary transfer nip T2 and after the recording material P passes through the secondary transfer nip T2. Further, the secondary transfer bias was made constant in setting corresponding to the position (penetration amount) of the back-up roller 3 during passing of the recording material P through the secondary transfer nip T2. On the other hand, in this embodiment, during passing of a single recording material P through the secondary transfer nip T2, the change of the position (penetration amount) of the back-up roller 3 and the change of setting of the secondary transfer bias corresponding to the position (penetration amount) are made.

That is, as described above, the "white void" and the "scattering" at the portions in the neighborhood of the leading and trailing ends of the recording material P are liable to occur on the paper having the relatively high rigidity, such as the thick paper. However, although there is a difference in degree, there is a possibility that the "white void" and the "scattering" occur also on the recording material P having the small basis weight and the low rigidity. For that reason, irrespective of the kind of the recording material P, it is effective that the penetration amount X of the back-up roller 3 is made relatively small when the portions in the neighborhood of the leading and trailing ends of the recording material P pass through the secondary transfer nip T2 and the neighborhood thereof on the upstream side. Here, the neighborhood of the secondary transfer nip T2 on the upstream side is specifically an opposing region to the intermediary transfer belt 1 from the contact region between the back-up roller 3 and the intermediary transfer belt 1 to the secondary transfer nip T2 with respect to the rotational direction of the intermediary transfer belt 1. On the other hand, in order to suppress the "transfer void" in the paper having the relatively low smoothness, when a central portion of the recording material P passes through the secondary transfer nip T2, it is effective that the penetration amount X of the back-up roller 3 is made relatively large.

Therefore, in this embodiment, in a period in which the first region with a predetermined width from the leading end toward the trailing end of the recording material P and the second region with a predetermined width from the trailing end toward the leading end of the recording material P passes through the secondary transfer nip T2 and the neighborhood thereof on the upstream side, the penetration amount X of the back-up roller 3 is X1 (0 mm). Further, in a period in which the recording material P passes through the secondary transfer nip T2 in a state of the penetration amount X1 (first state), the secondary transfer bias subjected to the constant-voltage control at the voltage value (V1+Vp) corresponding to the penetration amount X1 is applied to the outer secondary transfer roller 2. On the other hand, in a period in which the third region between the first region and the second region passes through the secondary transfer nip T2, the penetration amount X of the back-up roller 3 is X2 (2 mm). Further, in a period in which the recording material P passes through the secondary transfer nip T2 in a state of the penetration amount X2 (second state), the secondary transfer bias subjected to the constant-voltage control at the voltage value (V2+Vp) corresponding to the penetration amount X2 is applied to the outer secondary transfer roller 2. The widths of the first region and the second region with respect to the feeding direction of the recording material P can be appropriately set depending on a suppressing effect of the "white void" and the "scattering" in the neighborhoods of the leading and trailing ends of the recording material P, a suppressing effect of the "transfer void" at the central portion of the recording material P, or widths of an image forming region and a marginal region.

Incidentally, in this embodiment, setting of the secondary transfer bias depending on the position (penetration amount) of the back-up roller 3 can be determined similarly as in Embodiment 1 or Embodiment 2.

FIG. 12 shows an example of a voltage/current waveform of the secondary transfer portion T2 during image formation (during secondary transfer) on a single recording material P in this embodiment. In this embodiment, as the recording material P, "LEATHAC 66, basis weight: 250 gsm" which is embossed paper was used. Further, the penetration amount X of the back-up roller 3 is X1 (0 mm) in a period in which a first region of 20 mm from the leading end toward the trailing end of the recording material P and a second region of 20 mm from the trailing end toward the leading end of the recording material P passes through the secondary transfer nip T2 and the neighborhood thereof on the upstream side. Further, in a period in which the recording material P passes through the secondary transfer nip T2 in the state of the penetration amount X1, the secondary transfer bias subjected to the constant-voltage control at the voltage value (V1+Vp) corresponding to the penetration amount X1 is applied to the outer secondary transfer roller 2. On the other hand, the penetration amount X of the back-up roller 3 is X2 (2 mm) in a period in which a third region between the first region and the second region passes through the secondary transfer nip T2 and the neighborhood thereof on the upstream side. Further, in a period in which the recording material P passes through the secondary transfer nip T2 in the state of the penetration amount X2, the secondary transfer bias subjected to the constant-voltage control at the voltage value (V2+Vp) corresponding to the penetration amount X1 is applied to the outer secondary transfer roller 2. Thus, irrespective of the kind of the recording material P, not only the position (penetration amount) of the back-up roller 3 is optimized so as to suppress the image defect in the neighborhood of the leading and trailing ends of the recording material P, but also setting of the secondary transfer bias is optimized depending on the position (penetration amount) of the back-up roller 3.

Here, the widths of the first region and the second region with respect to the feeding direction of the recording material P may be equal to or different from each other. Further, with respect to at least one of the first region and the second region, similarly as described above, control such that the penetration amount of the back-up roller 3 is X1 and setting of the secondary transfer bias corresponding to the penetration amount X1 is made can be carried out. Further, as regards the first region and the second region, timing when the penetration amount of the back-up roller 3 is X1 can be typically set in the following manner. That is, the penetration amount of the back-up roller 3 is made X1 until each of the leading end and the trailing end of the recording material P passes through a free end of the first guiding member 81 (i.e., at the time of the passing, immediately before the passing or immediately after the passing) with respect to the feeding direction of the recording material P. The controller 50 is capable of detecting the position of the recording material P from a size of the recording material P, a length of a feeding path, feeding timing and the like. Or, the controller 50 may also detect the position of the recording material P on the basis of a detection result of a recording material sensor as a recording material detecting means for detecting the leading end and the like of the recording material P.

An optimum value of the setting of the secondary transfer bias is determined from the viewpoints of the density, the image quality and the like in advance. In this embodiment, as an example, Itgt was 60 μA, Vp was 750 V, V1 was 2500 V, and V2 was 2250 V.

Incidentally, the change of the position (penetration amount) of the back-up roller 3 and the change of the setting of the secondary transfer bias for single recording material P in accordance with this embodiment may be carried out for all the kinds of recording materials P and may also be carried out for a particular single kind or a plurality of kinds of recording materials P.

Thus, in this embodiment, the controller 50 effects the following control. That is, the controller 50 causes the image forming apparatus to execute the operation in the first mode in a period in which at least one of the first region with the predetermined width from the leading end toward the trailing end of the recording material P and the second region with the predetermined width from the trailing end toward the leading end of the recording material P passes through the transfer portion T2. Further, the controller 50 causes the image forming apparatus to execute the operation in the second mode in a period in which the third region between the first region and the second region of the recording material P passes through the transfer portion T2. In this embodiment, switching of the position of the supporting member 3 between the first position and the second position is carried out in a period in which the recording material P passes through the transfer portion T2.

As described above, according to this embodiment, it becomes possible to suppress the improper transfer due to the excess and deficiency of the transfer bias while compatibly realizing the suppression of the image defect in the neighborhood of the leading and trailing ends of the recording material P and the suppression of the image defect at the central portion of the recording material P.

Other Embodiments

The present invention was described above based on specific embodiments, but is not limited thereto.

In the above-described embodiments, the case where the position (penetration amount) of the supporting member is changed to the two levels was described, but may also be stepwisely changed to three or more levels or substantially changed continuously. For example, in the case where the position (penetration amount) of the supporting member is changed to the three or more levels, similarly as in Embodiment 2, on the basis of a result of the ATVC at one position (penetration amount), setting of the secondary transfer bias corresponding to another position (penetration amount) or a plurality of other positions (penetration amounts) can be determined. That is, the above-described coefficient C may also be set at a plurality of values depending on the number of settings of the positions (penetration amounts) of the supporting member.

In the above-described embodiments, the supporting member is the roller-shaped member, but may also be members in arbitrary forms, such as a pad-shaped member, a sheet-shaped (film-shaped) member, a brush-shaped member, and the like.

In the above-described embodiments, the case where the belt-shaped image bearing member was the intermediary transfer belt was described, but the present invention is applicable when an image bearing member constituted by an endless belt for feeding the toner image borne at the image forming position is used. Examples of such a belt-shaped image bearing member may include a photosensitive (member) belt and an electrostatic recording dielectric (member) belt, in addition to the intermediary transfer belt in the above-described embodiments.

The present invention can be carried out also in other embodiments in which a part or all of the constitutions of the above-described embodiments are replaced with alternative constitutions thereof. Accordingly, when the image forming apparatus using the belt-shaped image bearing member is used, the present invention can be carried out with no distinction as to tandem type/single drum type, a charging type, an electrostatic image forming type, a developing type, a transfer type and a fixing type. In the above-described embodiments, a principal part relating to the toner image formation/transfer was described principally, but the present invention can be carried out in various uses, such as printers, various printing machines, copying machines, facsimile machines and multi-function machines, by adding necessary devices, equipment and casing structure.

According to the present invention, even in the constitution in which the position of the supporting member is changeable, the improper transfer due to the excess and deficiency of the transfer bias can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-094149 filed on May 15, 2018, which is hereby incorporated by reference herein in its entirety.

What is claimed is:

1. An image forming apparatus comprising:

an endless belt configured to carry a toner image transferred at a first transfer position;

an outer roller contacting an outer peripheral surface of said belt and configured to transfer the toner image from said belt onto a recording material at a secondary transfer position;

a plurality of stretching rollers configured to stretch said belt, wherein said stretching rollers include an inner roller provided correspondingly to the secondary transfer position and an upstream roller provided on a side downstream of the first transfer position and upstream of said inner roller with respect to a rotational direction of said belt;

a voltage source configured to apply a transfer bias, to said outer roller or said inner roller, for transferring the toner image from said belt onto the recording material;

a supporting member contactable to an inner peripheral surface of said belt on a side upstream of said inner roller and downstream of said upstream roller with respect to the rotational direction of said belt;

a moving mechanism configured to move said supporting member between a first position and a second position different from the first position in a plane substantially perpendicular to a rotational axis direction of said inner roller;

a sensor configured to detect a current value or a voltage value when a bias is applied from said voltage source to said outer roller or said inner roller; and a controller capable of executing an operation in a first mode in which an image is formed on the recording material in a state in which said supporting member is disposed at the first position and an operation in a second mode in which the image is formed on the recording material in a state in which said supporting member is disposed at the second position, and capable of executing an operation in a test mode in which, during non-image formation, the transfer bias is adjusted on the basis of a detection result of said sensor acquired under application of a test bias from said voltage source to said outer roller or said inner roller, wherein on the basis of a first detection result of said sensor acquired under application of the test bias in the state in which said supporting member is disposed at the first position, said controller determines a first transfer bias to be applied from said voltage source to said outer roller or said inner roller during the operation in the first mode, and on the basis of a second detection result of said sensor acquired under application of the test bias in the state in which said supporting member is disposed at the second position, said controller determines a second transfer bias to be applied from said voltage source to said outer roller or said inner roller during the operation in the second mode.

2. An image forming apparatus according to claim 1, wherein on the basis of the first detection result of said sensor acquired under application of the test bias in the state in which said supporting member is disposed at the first position in a pre-rotation step of a job in which the operation in the first mode and the operation in the second mode are to be executed, said controller determines the first transfer bias to be applied from said voltage source to said outer roller or said inner roller during the operation in the first mode, and wherein on the basis of the second detection result of said sensor acquired under application of the test bias in the state in which said supporting member is disposed at the second position after execution of the operation in the first mode and before execution of the operation in the second mode, said controller determines the second transfer bias to be applied from said voltage source to said outer roller or said inner roller during the operation in the second mode.

3. An image forming apparatus according to claim 1, wherein said supporting member is separated from said belt when said supporting member is in the first position, and contacts said belt when said supporting member is in the second position.

4. An image forming apparatus according to claim 1, wherein with respect to the rotational direction of said belt, an upstream end of a contact region between said outer roller and said belt is positioned upstream of an upstream end of a contact region between said inner roller and said belt.

5. An image forming apparatus comprising:

an endless belt configured to carry a toner image transferred at a first transfer position;

an outer roller contacting an outer peripheral surface of said belt and configured to transfer the toner image from said belt onto a recording material at a secondary transfer position;

a plurality of stretching rollers configured to stretch said belt, wherein said stretching rollers include an inner roller provided correspondingly to the secondary transfer position and an upstream roller provided on a side downstream of the first transfer position and upstream of said inner roller with respect to a rotational direction of said belt;

a voltage source configured to apply a transfer bias, to said outer roller or said inner roller, for transferring the toner image from said belt onto the recording material;

a supporting member contactable to an inner peripheral surface of said belt on a side upstream of said inner roller and downstream of said upstream roller with respect to the rotational direction of said belt;

a moving mechanism configured to move said supporting member between a first position and a second position different from the first position in a plane substantially perpendicular to a rotational axis direction of said inner roller;

a sensor configured to detect a current value or a voltage value when a bias is applied from said voltage source to said outer roller or said inner roller; and a controller capable of executing an operation in a first mode in which an image is formed on the recording material in a state in which said supporting member is disposed at the first position and an operation in a second mode in which the image is formed on the recording material in a state in which said supporting member is disposed at the second position, and capable of executing an operation in a test mode in which, during non-image formation, the transfer bias is adjusted on the basis of a detection result of said sensor acquired under application of a test bias from said voltage source to said outer roller or said inner roller, wherein on the basis of a detection result of said sensor acquired under application of the test bias in the state in which said supporting member is disposed at the first position, said controller determines a first transfer bias to be applied from said voltage source to said outer roller or said inner roller during the operation in the first mode, and determines a second transfer bias to be applied from said voltage source to said outer roller or said inner roller during the operation in the second mode.

6. An image forming apparatus according to claim 5, wherein said controller determines the second transfer bias on the basis of the detection result and a predetermined relationship set in advance.

7. An image forming apparatus according to claim 5, wherein in a plane substantially perpendicular to the rotational axis direction of said inner roller, when a common tangential line between said inner roller and said upstream roller on a side where said belt is stretched is a reference line L, a tangential line of said belt which is substantially parallel to the reference line and which is in a contact region between said supporting member and said belt is a supporting portion tangential line Ld, and a distance between the reference line and the supporting portion reference line Ld is a penetration amount X which is a positive value when the supporting portion reference line Ld is further in a direction outside of said belt than the reference line L is, the penetration amount X includes a first penetration amount X1 during the first mode and a second penetration amount X2 during the second mode, and the second penetration amount X2 is greater than the first penetration amount Xl, and wherein an absolute value of the second transfer bias is less than an absolute value of the first transfer bias.

8. An image forming apparatus according to claim 5, wherein said controller effects control so as to execute the operation in the first mode when the transfer is carried out on a recording material of a first kind and so as to execute the operation in the second mode when the transfer is carried out on a recording material of a second kind different from the first kind.

9. An image forming apparatus according to claim 8, wherein the recording material of the first kind has a basis weight greater than a basis weight of the recording material of the second kind.

10. An image forming apparatus according to claim 5, wherein said controller executes the operation in the first mode when at least one of a first region having a predetermined width from a leading end of the recording material toward a trailing end side and a second region having a predetermined width from a trailing end toward a leading end side passes through the second transfer position, and executes the operation in the second mode when a third region between the first region and the second region passes through the second transfer position.

11. An image forming apparatus according to claim 5, wherein said controller acquires a detection result of said sensor under application of the test bias in the state in which said supporting member is disposed at the first position in a pre-rotation step of a job in which the operation in the first mode and the operation in the second mode are to be executed, and executes the test mode in which both the first test bias and the second test bias are determined.

12. An image forming apparatus according to claim 5, wherein said controller determines the second transfer bias on the basis of the detection result with no application of the test bias in the state in which said supporting member is disposed at the second position, and the second transfer bias is different from the first transfer bias.

13. An image forming apparatus comprising:

an image forming portion configured to form a toner image on a photosensitive member;

an intermediary transfer belt onto which the toner image formed on said photosensitive member is transferred;

a secondary transfer roller forming a transfer portion in which a recording material is nipped between said secondary transfer roller and said intermediary transfer belt and configured to transfer the toner image from said intermediary transfer belt onto the recording material;

an inner roller provided in contact with an inner peripheral surface of said intermediary transfer belt at a position where the transfer portion is formed and configured to stretch said intermediary transfer belt;

a back-up member provided upstream of and adjacent to said inner roller with respect to a rotational direction of said intermediary transfer belt and being contactable with and movable to an inner peripheral surface of said intermediary transfer belt;

a moving mechanism configured to move said back-up member;

a voltage source configured to apply a voltage to said secondary transfer roller or said inner roller;

a detecting portion configured to detect an output voltage or an output current of said voltage source; and a controller configured to, during a preparatory operation executed at a time from input of a start instruction of an image forming job before the toner image is transferred onto a first recording material to which the image is to be first transferred in an image forming job:

position said back-up member in a position for the first recording material, then control said voltage source so that a test bias is applied by said voltage source, and then set the voltage to be applied by said voltage source when the toner image is transferred onto the first recording material on the basis of a detection result of said detecting portion when the test bias is applied, wherein depending on a kind of the recording material, said controller positions said back-up member to one of a plurality of positions including a first position where said back-up member and said intermediary transfer belt contact one another and a second position where said back-up member is separated from said intermediary transfer belt.

14. An image forming apparatus according to claim 13, wherein the kind of the recording material is defined by a basis weight of the recording material.

15. An image forming apparatus according to claim 14, wherein when the basis weight of the recording material is less than a predetermined amount, said controller positions said back-up member at the first position, and when the basis weight of the recording material is the predetermined amount or greater, said controller positions said back-up member at the second position.

16. An image forming apparatus according to claim 13, wherein said back-up member is positioned at the position for the first recording material from application of the test bias until the toner image is transferred onto the first recording material.

17. An image forming apparatus according to claim 13, wherein when, during the image forming job, the position of said back-up member is changed in a period between a recording material and a subsequent recording material, a test bias is applied by said voltage source after the position of said back-up member is changed to a position for the subsequent recording material, and then on the basis of a detection result of said detecting portion at that time, said controller sets the voltage to be applied by said voltage source when the toner image is transferred onto the subsequent recording material.

18. An image forming apparatus according to claim 13, wherein the kind of the recording material is defined by smoothness of the recording material.

19. An image forming apparatus comprising:

an image forming portion configured to form a toner image on a photosensitive member;

an intermediary transfer belt onto which the toner image formed on said photosensitive member is transferred;

a secondary transfer roller forming a transfer portion at which a recording material is nipped between said secondary transfer roller and said intermediary transfer belt and configured to transfer the toner image from said intermediary transfer belt onto the recording material;

an inner roller provided in contact with an inner peripheral surface of said intermediary transfer belt at a position where the transfer portion is formed and configured to stretch said intermediary transfer belt;

an upstream roller provided in contact with the inner peripheral surface of said intermediary transfer belt and provided upstream of and adjacent to said inner roller with respect to a rotational direction of said intermediate transfer belt;

a back-up member provided upstream of and adjacent to said inner roller with respect to the rotational direction of said intermediary transfer belt and being contactable with and movable to the inner peripheral surface of said intermediary transfer belt;

a moving mechanism configured to move said back-up member;

a voltage source configured to apply a voltage to said secondary transfer roller or said inner roller;

a detecting portion configured to detect an output voltage or an output current of said voltage source; and a controller configured to, during a preparatory operation executed at a time from input of a start instruction of an image forming job until before the toner image is transferred onto a first recording material to which the image is to be first transferred in the image forming job:

position said back-up member in a position for the first recording material, then control said voltage source so that a test bias is applied by said voltage source, and then set the voltage to be applied by said voltage source when the toner image is transferred onto the first recording material on the basis of a detection result of said detecting portion when the test bias is applied, wherein depending on a kind of the recording material, said controller positions said back-up member at one of a plurality of positions including a first position where a penetration amount of said back-up member through a common tangential line between said inner roller and said upstream roller on a side where said intermediary transfer belt is stretched is a first penetration amount and a second position where the penetration amount is a second penetration amount greater than the first penetration amount.

20. An image forming apparatus according to claim 19, wherein the kind of the recording material is defined by a basis weight of the recording material.

21. An image forming apparatus according to claim 20, wherein when the basis weight of the recording material is less than a predetermined amount, said controller positions said back-up member at the first position, and when the basis weight of the recording material is the predetermined amount or more, said controller positions said back-up member at the second position.

22. An image forming apparatus according to claim 19, wherein said back-up member is positioned at the position for the first recording material from application of the test bias until the toner image is transferred onto the first recording material.

23. An image forming apparatus according to claim 19, wherein when, during the image forming job, the position of said back-up member is changed in a period between a recording material and a subsequent recording material, a test bias is applied by said voltage source after the position of said back-up member is changed to a position for the subsequent recording material, and then on the basis of a detection result of said detecting portion at that time, said controller sets the voltage applied by said voltage source when the toner image is transferred onto the subsequent recording material.

24. An image forming apparatus according to claim 19, wherein the kind of the recording material is defined by smoothness of the recording material.

25. An image forming apparatus according to claim 13, wherein said voltage source is configured to apply the voltage to said inner roller.

26. An image forming apparatus according to claim 19, wherein said voltage source is configured to apply the voltage to said inner roller.

* * * * *